US010835429B2

(12) United States Patent
Lykkegaard

(10) Patent No.: US 10,835,429 B2
(45) Date of Patent: Nov. 17, 2020

(54) LIFTING MECHANISM

(71) Applicant: Pride Mobility Products Corp., Exeter, PA (US)

(72) Inventor: Frank Lykkegaard, Åbyhøj (DK)

(73) Assignee: PRIDE MOBILITY PRODUCTS CORPORATION, Exeter, PA (US)

( * ) Notice: Subject to any disclaimer, the term of this patent is extended or adjusted under 35 U.S.C. 154(b) by 13 days.

(21) Appl. No.: 15/770,403

(22) PCT Filed: Oct. 21, 2016

(86) PCT No.: PCT/US2016/058282
§ 371 (c)(1),
(2) Date: Apr. 23, 2018

(87) PCT Pub. No.: WO2017/070586
PCT Pub. Date: Apr. 27, 2017

(65) Prior Publication Data

US 2018/0311091 A1 Nov. 1, 2018

(30) Foreign Application Priority Data

Oct. 23, 2015 (DK) ..... 2015 00656

(51) Int. Cl.
*A61G 5/10* (2006.01)
*A61G 3/06* (2006.01)
(Continued)

(52) U.S. Cl.
CPC ..... *A61G 5/1059* (2013.01); *A61G 5/107* (2013.01); *A61G 3/063* (2013.01); *A61G 5/14* (2013.01);
(Continued)

(58) Field of Classification Search
CPC .... A61G 13/06; A61G 2200/34; A61G 3/063; A61G 5/1059; A61G 5/107; A61G 5/14; A61G 7/012; A61G 7/1017; A61G 7/1059
(Continued)

(56) References Cited

U.S. PATENT DOCUMENTS 2,766,007 A * 10/1956 Krilanovich ..... F16M 13/00 254/124
3,102,713 A * 9/1963 De Paoli ..... B66F 7/0625 254/8 R
(Continued)

FOREIGN PATENT DOCUMENTS

CN 203238003 U 10/2013
CN 204848118 U 12/2015
(Continued)

OTHER PUBLICATIONS

International Search Report and Written Opinion dated Dec. 22, 2016 for International Patent Application No. PCT/US16/85282, 12 pages.
(Continued)

*Primary Examiner* — Joseph J Hail
*Assistant Examiner* — Arman Milanian
(74) *Attorney, Agent, or Firm* — Morgan, Lewis & Bockius LLP

(57) ABSTRACT

A platform link mechanism may include a base with a first member rotatably coupled to the base. A second member may be coupled to the first member. The second member may be moveable with respect to the first member between a first position and a second position. A lifting link assembly may be rotatably coupled to each of the base and the second member. A platform mount may be coupled to the second member. The platform mount may be rotatable about a platform pivot with respect to the second member. The
(Continued)

lifting link assembly may rotate relative to the first member, the second member, and the base as the second member moves relative to the first member. The first member may rotate relative to the base as the lifting link assembly rotates relative to the first member.

28 Claims, 15 Drawing Sheets

(51) Int. Cl.

| | |
|---|---|
| *A61G 7/10* | (2006.01) |
| *A61G 13/06* | (2006.01) |
| *A61G 7/012* | (2006.01) |
| *A61G 5/14* | (2006.01) |

(52) U.S. Cl.
CPC ..... *A61G 7/012* (2013.01); *A61G 7/1017* (2013.01); *A61G 7/1059* (2013.01); *A61G 13/06* (2013.01); *A61G 2200/34* (2013.01)

(58) Field of Classification Search
USPC ..... 254/10 C, 8 R; 414/546
See application file for complete search history.

(56) References Cited

U.S. PATENT DOCUMENTS

| | | | | |
|---|---|---|---|---|
| 3,915,429 | A * | 10/1975 | Zelli | B66F 11/048 254/8 R |
| 4,946,222 | A | 8/1990 | Matson | |
| 6,238,169 | B1 | 5/2001 | Dupuy et al. | |
| 6,739,824 | B2 | 5/2004 | Dupuy et al. | |
| 6,837,670 | B2 | 1/2005 | Goodrich | |
| 7,441,995 | B2 * | 10/2008 | Sobota | A61G 3/06 410/7 |
| 7,896,134 | B2 | 3/2011 | Morris et al. | |
| 8,544,866 | B2 | 10/2013 | Noonan et al. | |
| 2005/0046129 | A1 * | 3/2005 | Antonishak | A61G 5/043 280/47.4 |
| 2007/0084648 | A1 * | 4/2007 | DuFresne | A61G 5/1059 180/65.1 |
| 2014/0262566 | A1 * | 9/2014 | Davis | A61G 5/1059 180/54.1 |
| 2015/0196441 | A1 | 7/2015 | Mulhern et al. | |

FOREIGN PATENT DOCUMENTS

| | | | | |
|---|---|---|---|---|
| DE | 7043924 | U | 5/1971 | |
| DE | 19821021 | A1 | 11/1999 | |
| DE | 102005005829 | A1 * | 8/2006 | A61G 5/1059 |
| DE | 102005005829 | A1 | 8/2006 | |

OTHER PUBLICATIONS

Examination report No. 1 for standard patent application dated Sep. 19, 2018 for Australian Patent Application No. 2016342356.
Chinese Office Action dated Mar. 20, 2019 for Chinese Application No. 20160068439.5, 6 pages.
Canadian Office Action dated Apr. 25, 2019 for Canadian Patent Application No. 3,002,568, 4 pages.
Canadian Office Action for Canadian Patent Application No. 3002568 dated Dec. 23, 2019, 8 pages.
Australian Examination Report No. 1 dated Aug. 13, 2019 for Australian Patent Application No. 2019202301, 4 pages.
European Search Report and Written Opinion for European Patent Application No. 16858378.9 dated May 6, 2019, 6 pages.
Canadian Office Action dated Aug. 31, 2020 for Canadian Patent Application No. 3,002,568, 9 pages.

* cited by examiner

LIFTING MECHANISM

CROSS-REFERENCE TO RELATED APPLICATIONS

This application is a U.S. national stage entry of international patent application no. PCT/US2016/058282, filed Oct. 21, 2016, which claims the benefit of Denmark Patent Application No. 2015 00656 filed Oct. 23, 2015 entitled "Lifting Mechanism", each of which is incorporated by reference herein in their entirety.

BACKGROUND OF THE INVENTION

The present invention generally relates to personal mobility products and, more particularly, aspects of personal mobility devices that accommodate lifting portions of the device such as seats.

Some conventional wheelchairs include a lifting system enabling an occupant to be seated at different heights. However, conventional systems can be bulky. Some are not aesthetically pleasing or take up too much space. It is desirable to create form factors that allow lifting mechanism to stow partially or completely and that may for example fit completely underneath the seat. An exposed lift system may also create pinch points which pose a threat of injury or damage if a user's finger, etc. is caught in the lift mechanism. Some conventional systems also move the center of gravity of the seat and the user horizontally with respect to a base as the system is elevated. Such horizontal movement creates a risk of instability. Conventional systems also rely on cumbersome or complex systems to maintain an orientation of the seat to a horizon while the lifting system moves the seat from a lowered position to a raised position.

Therefore, a need exists for a compact lifting mechanism that minimizes horizontal movement of the center of gravity of the system, reduces pinch points, and maintains the orientation of the seat with respect to the horizon during operation of the lifting mechanism.

BRIEF SUMMARY OF THE INVENTION

In one embodiment there is a platform link mechanism including a base with a first member rotatably coupled to the base. A second member may be coupled to the first member. The second member may be moveable with respect to the first member between a first position and a second position. A lifting link assembly may be rotatably coupled to each of the base and the second member. A platform mount may be coupled to the second member. The platform mount may be rotatable about a platform pivot with respect to the second member. The lifting link assembly may rotate relative to the first member, the second member, and the base as the second member moves relative to the first member. The first member may rotate relative to the base as the lifting link assembly rotates relative to the first member.

In a further embodiment, a platform link assembly may be coupled to each of the second member and the platform mount, wherein the platform link assembly is configured to maintain an orientation of the platform. Orientation of the platform may include one of a) an orientation of an aspect of the platform mount with respect to a horizon, b) an orientation of an aspect of the platform mount relative to a vertical plane passing through the platform mount, or c) both a) and b). The lifting link assembly may include a base link rotatably coupled to the base, a lifting link rotatably coupled to the second member, and a receiving link coupled to each of the base link and the lifting link. The receiving link may rotate relative to the base link as the lifting link rotates relative to the first member, thereby causing the first member to rotate relative to the base. The platform mount may move from a lowered position to an elevated position as the first member rotates relative to the base. A plane fixed on the platform mount may maintain a substantially fixed angle relative to the horizon as the platform mount moves from the lowered position to the elevated position as the first member rotates relative to the base. A plane fixed on the platform mount may maintain a substantially fixed angle relative to the horizon as the platform mount moves from the lowered position to the elevated position as the lift mechanism moves from the lowered configuration to the elevated configuration. A center of gravity of the platform mount may remain at a substantially fixed horizontal distance from a point where the first member is pivotally mounted to the base as the platform mount moves from the lowered position to the elevated position as the lift mechanism moves from the lowered configuration to the elevated configuration. The platform mount may lie within a vertical plane when the platform mount is in the lowered configuration and the platform mount may move a maximum of 2 inches from the vertical plane as the lift mechanism moves from the lowered configuration to the elevated configuration. One of the first member and the second member may be telescopically nested within the other of the first member and the second member. The second member may be translatable with respect to the first member.

In another embodiment, an actuator is coupled to the second member and may be configured to move the second member relative to the first member. The actuator may comprise at least one of a piston within a cylinder and a threaded rod. The lifting link may be coupled to the second member at a lifting link pivot. The lifting link may have an effective link length between the lifting link pivot and the receiving link, and the effective link length may be configured to change as the lift mechanism moves from the lowered configuration to the elevated configuration. The receiving link may be configured to slidingly receive the lifting link such that the effective link length changes as the lift mechanism moves from the lowered configuration to the elevated configuration. the lifting link may comprise an inner lifting link telescopically nested within an outer lifting link such that the lifting link may telescopically expand and contract as the lifting link rotates relative to the first member. The lifting link may be rotationally fixed relative to the receiving link.

The platform link assembly may include a platform link rotatably coupled to the platform mount and moveably coupled to the platform mount and moveably coupled to the first member. The first member may include a first member track and the platform link may include a journal configured to move along the first member track as the lift mechanism moves from the lowered configuration to the elevated configuration. The track may comprise a slot. The first member track may include a first arcuate portion. The first member track may include a second arcuate portion connected to the first arcuate portion. One of the first arcuate portion and the second arcuate portion may be convex relative to a lower surface of the first member and the other of the first arcuate portion and the second arcuate portion may be concave relative to the lower surface of the first member. The second member may include a second member track and the journal may be configured to move along the first member track and the second member track simultaneously as the lift mechanism moves from the lowered configuration to the elevated configuration. The second member track may be transverse to the first member track. The platform link assembly may comprise an L-shaped link. The platform link assembly may comprise a multi-branched link including a branch rotatably coupled to the second member.

The platform link assembly may include a platform link, an intermediate link rotatably coupled to the platform link, and a connecting link rotatably coupled to each of the intermediate link and the lifting link assembly such that the connecting link rotates relative to the lifting link assembly as the lifting link assembly rotates relative to the second member. The connecting link may be rotatably coupled to the lifting link. The intermediate link may be rotatably coupled to the second member at an intermediate pivot. The intermediate link may include a first intermediate end and a second intermediate end with the intermediate pivot point between the first intermediate end and the second intermediate end. The intermediate link may rotate about the intermediate pivot point as the connecting link rotates relative to the lifting link assembly. The platform link may rotate relative to each of the intermediate link and the platform mount as the intermediate link rotates about the intermediate pivot point. The platform mount may rotate relative to the second member as the platform link rotates relative to the platform mount such that the orientation of the platform mount with respect to a horizon is maintained. The first member may include a cavity and the second member, lifting link, receiving link, and base link may be at least partially within the cavity when the lift mechanism is in the lowered configuration. The platform lift mechanism may include a maximum length of less than twenty two inches.

In a further embodiment, an actuator may be configured to move the first member such that the platform mount moves from a lowered position to an elevated position in less than forty-five seconds. The platform lift mechanism may be configured to support a load of four hundred pounds on the platform mount as the lift mechanism moves from the lowered configuration to the elevated configuration.

In one embodiment, a method of lifting a platform while maintaining an angular orientation of the platform with respect to a horizon includes moving a second member relative to a first member, the first member being rotatably coupled to a base and the second member being rotatably coupled to a platform mount; wherein moving the second member causes a lifting link assembly to rotate relative to the first member, the second member, and the base; wherein rotation of the lifting link assembly causes the first member to rotate relative to the base; wherein rotation of the lifting link assembly causes a platform link assembly to rotate relative to the second member; wherein rotation of the platform link assembly causes rotation of the platform mount relative to the second member, thereby maintaining an orientation of the platform mount. The orientation of the platform may include one of a) an orientation of an aspect of the platform mount with respect to a horizon, b) an orientation of an aspect of the platform mount relative to a vertical plane passing through mount, or c) both a) and b). The lifting link assembly may include a base link rotatably coupled to the base, a lifting link rotatably coupled to the second member, and a receiving link rotatably coupled to the base link and coupled to the lifting link; and moving the second member may include rotating the receiving link relative to the base link as the lifting link rotates relative to the first member, thereby causing the first member to rotate relative to the base. Moving the second member may include maintaining a substantially fixed angle relative to the horizon as the lift mechanism moves from the lowered configuration to the elevated configuration. Moving the second member may include maintaining a center of gravity of the platform mount at a substantially fixed distance from a point where the first member may be pivotably mounted to the base as the platform mount moves from a lowered position to an elevated position. Moving the second member may include activating an actuator. Moving the second member may include telescopically extending the second member relative to the first member. Moving the second member may include at least one of moving a piston within a cylinder and rotating a threaded rod.

The lifting link may include an effective link length and moving the second member may include changing the effective link length as the lift mechanism moves from the lowered configuration to the elevated configuration. The receiving link may include a first end rotatably coupled to the base link, a second end coupled to the lifting link and the first member may be rotatably coupled to the receiving link at a receiving pivot between the first end and the second end. Moving the second member may include rotating the receiving link about the receiving pivot. Moving the second member may include moving the platform link assembly along a first track in the first member. Moving the second member may include moving the platform link assembly within a second track in the second member. The platform lift mechanism may include a platform link, an intermediate link rotatably coupled to the platform link, and a connecting link rotatably coupled to each of the intermediate link and the lifting link assembly. Moving the second member may include rotating the connecting link relative to the lifting link assembly as the linking lift assembly rotates relative to the second member. Moving the second member may include rotating the intermediate link about an intermediate pivot relative to the second member as the connecting link rotates relative to the lifting link assembly. Moving the second member may include rotating the platform link relative to each of the intermediate link and the platform mount as the intermediate link rotates about the intermediate pivot point. Moving the second member may include rotating the platform mount relative to the second member as the platform link rotates relative to the platform mount such that the orientation of the platform mount with respect to the horizon may be maintained.

BRIEF DESCRIPTION OF THE SEVERAL VIEWS OF THE DRAWINGS

The foregoing summary, as well as the following detailed description of embodiments of the lifting mechanism, will be better understood when read in conjunction with the appended drawings of exemplary embodiments. It should be understood, however, that the invention is not limited to the precise arrangements and instrumentalities shown.

In the drawings.

DETAILED DESCRIPTION OF THE INVENTION

In some embodiments, a platform lift mechanism is configured to elevate a mobility device component such as a platform from a lowered position to a raised or elevated position. In one embodiment, the lift mechanism is configured to elevate a seat of a wheelchair. In some embodiments, the lift mechanism comprises a compact system in comparison to prior lift mechanisms. The lift mechanism, in one example, contains a linkage assembly enclosed (e.g., entirely or substantially entirely) within a telescoping low-profile single arm mechanism that is operable to pivot relative to a frame on the mobility device while a platform (or other aspect of the lift mechanism) coupled to the linkage assembly is elevated such that a chair (or other component so coupled) is retained (entirely or substantially) at an orientation relative to the horizon through-out the lift movement. In some embodiments, the chair (or other component) has a center of gravity that is retained (entirely or substantially) at a vertical orientation such that there is little or no forward or backward movement of the chair as the lift elevates or lowers. In some embodiments, the lift is capable of raising and lowering a chair all the while retaining its horizontal orientation and the chair's position relative to the front and back of the mobility device. In some embodiments, the lift mechanism fits beneath a wheelchair seat when the lift mechanism is in the lowered position. In some embodiments, the lift mechanism is configured to lift a platform or seat comprising a load of 600 pounds while being capable of retracting to stow beneath a seat such as a 22 inch wide seat. In some embodiments, the lift mechanism includes a lifting link assembly configured to pivot or rotate a first member relative to a base when a second member is moved relative to the first member (e.g., where the second member may telescope into or out of the first member). In some embodiments, a platform link assembly is configured to maintain an orientation of the platform or seat as the platform is elevated (e.g., as a result of first member rotating relative to the base). The platform link assembly may be coupled directly or indirectly to the lifting link assembly. In some embodiments, the platform link mechanism includes an actuator to move the second member relative to the first member. The actuator may be coupled (directly or indirectly) to either or both of the lifting link assembly and platform link assembly. In some embodiments, the platform link mechanism is configured to vertically raise a load while maintaining a fixed horizontal distance from a base such that center of gravity of the load is positioned above the system base to prevent toppling the system.

Figure 1:
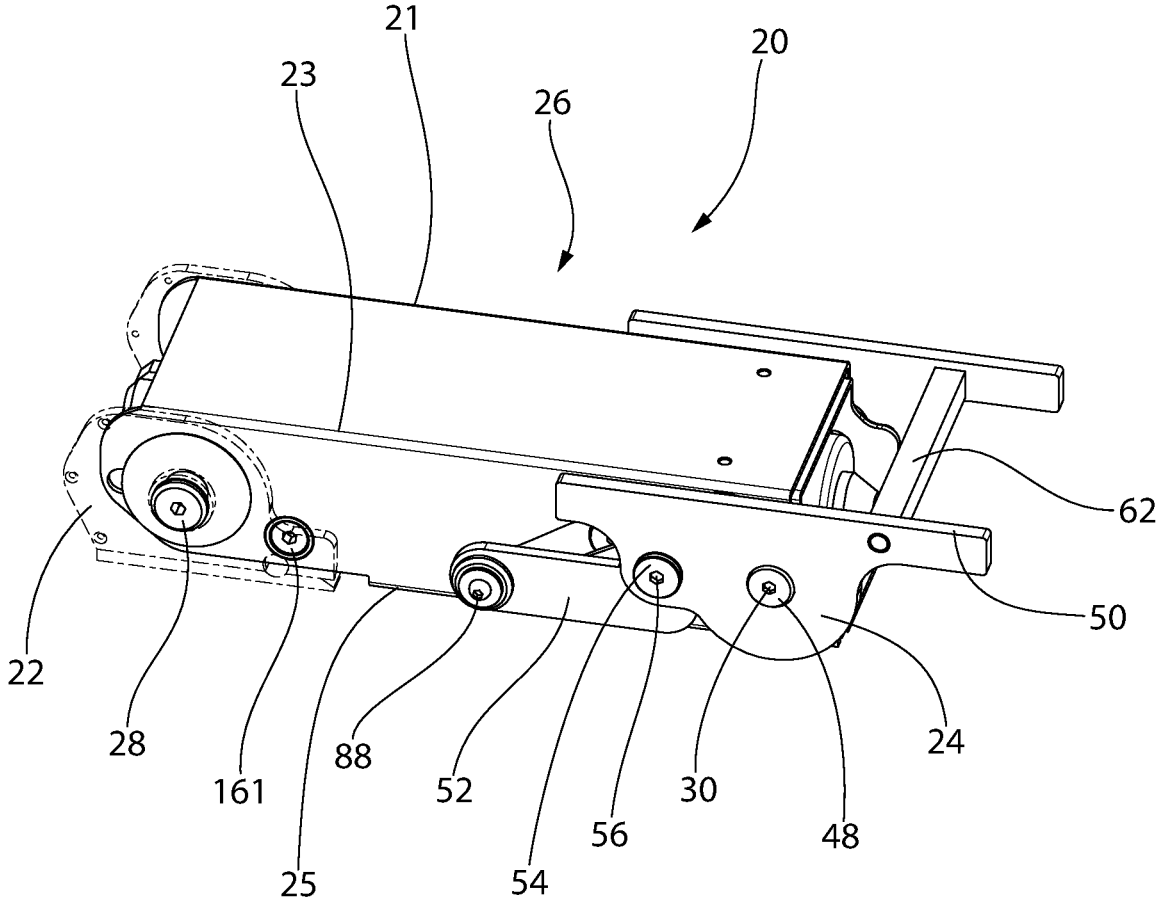
FIG. 1 is a top, side perspective view of a lift mechanism in accordance with an exemplary embodiment of the present invention in a lowered configuration.
Figure 2:
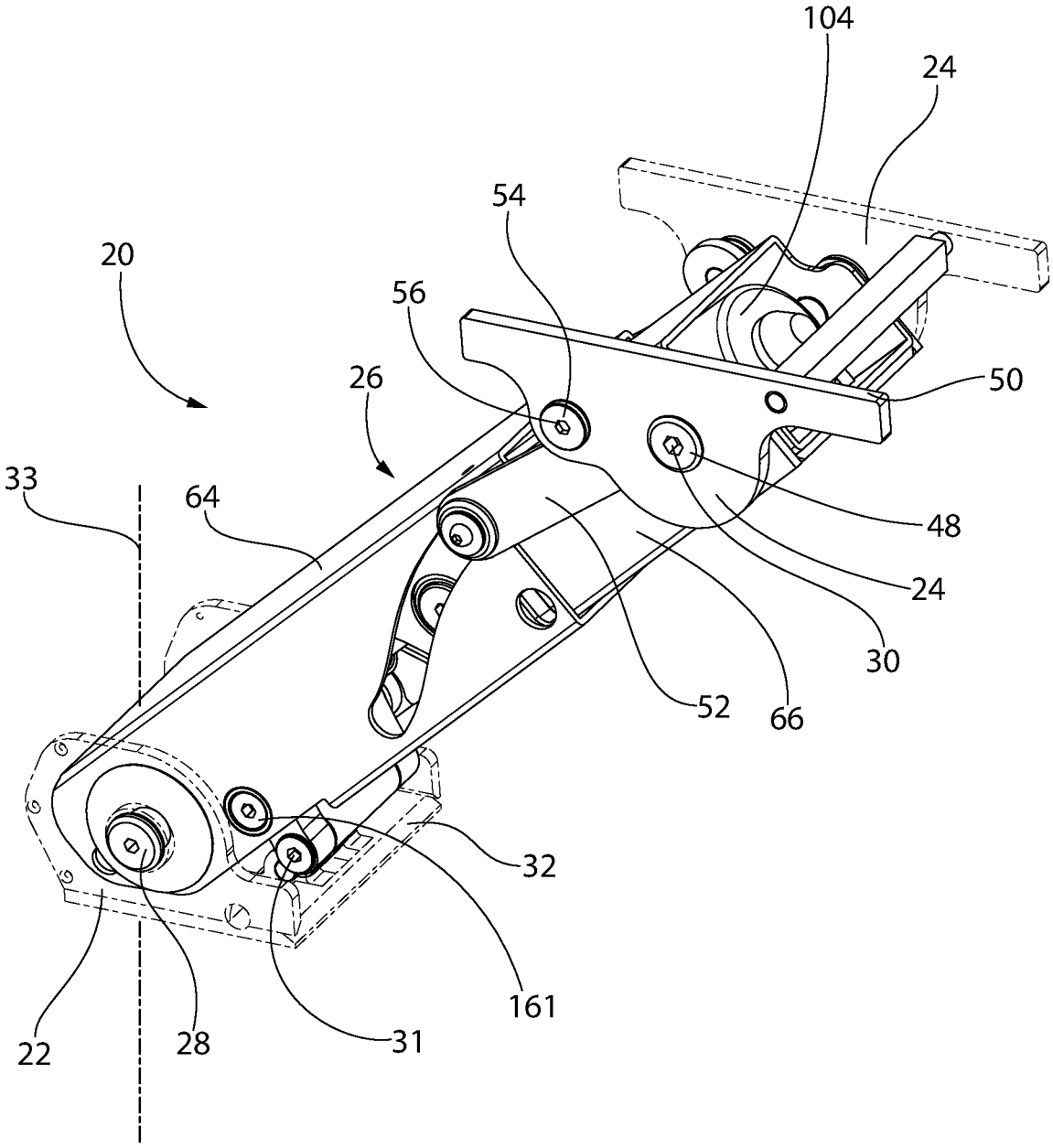
FIG. 2 is a top, side perspective view of the lift mechanism of FIG. 1 in an elevated configuration.

Referring to the drawings in detail, wherein like reference numerals indicate like elements throughout, there is shown in FIGS. 1-15 a lift mechanism, generally designated 20, in accordance with an exemplary embodiment of the present invention. In one embodiment, the lift mechanism 20 is configured to be attached to a wheelchair such as that disclosed in U.S. Patent Application Publication No. 2015/0196441 (which is hereby incorporated by reference in its entirety) to elevate a seated occupant and raise a wheelchair in a safe, stable manner. In some embodiments, the lift mechanism 20 is configured to be coupled to an unmanned vehicle to elevate a camera, robotic feature, etc. In some embodiments, the lift mechanism 20 is configured to be used in material handling applications (e.g., raising a container). In some embodiments, the lift mechanism 20 is configured to move between a lowered configuration (FIG. 1) and a raised configuration (FIG. 2). In some embodiments, an occupant may be at a conversational or level height with others who are standing or walking along the wheelchair when the lift mechanism is in the raised configuration. In some embodiments, the lift mechanism 20 includes a base 22. In some embodiments, the base 22 is configured to be fixed to a wheelchair support (not shown) to secure the lift mechanism to the wheelchair support. In some embodiments, the lift mechanism 20 includes a platform mount 24 configured to be fixed to a platform or an underside of a wheelchair seat (not shown). In one embodiment, the platform lift mechanism 20 is configured to raise the platform mount 24 more than 6 inches vertically from the base 22. In one embodiment, the platform lift mechanism 20 is configured to raise the platform mount 24 more than 7 inches vertically from the base 22. In one embodiment, the platform lift mechanism 20 is configured to raise the platform mount 24 more than 8 inches vertically from the base 22. In one embodiment, the platform lift mechanism 20 is configured to raise the platform mount 24 more than 9 inches vertically from the base 22. In one embodiment, the platform lift mechanism 20 is configured to raise the platform mount 24 more than 10 inches vertically from the base 22. In one embodiment, the platform lift mechanism 20 is configured to raise the platform mount 24 more than 11 inches vertically from the base 22. In one embodiment, the platform lift mechanism 20 is configured to raise the platform mount 24 more than 12 inches vertically from the base 22. In some embodiments, the lift mechanism 20 is defined by a length as measured between a proximal end 27 (FIG. 3) and a distal end 29. In some embodiments, the lift mechanism 20 is defined by a length such that lift mechanism fits partially or completely beneath a seat of a wheel chair when the lift mechanism is in the lowered (e.g., and/or retracted) configuration. In some embodiments, positioning the lift mechanism 20 beneath the seat reduces or eliminates exposure to moving parts of the lift mechanism 20. In some embodiments, the lift mechanism 20 includes a maximum length of 22 inches. In some embodiments, the lift mechanism 20 includes a member assembly 26 having a first edge 21, a second edge 23, a third edge 25, and a fourth edge (not visible in FIG. 1). In some embodiments, the member assembly 26 comprises a height as measured between the second edge 23 and the third edge 25. In one embodiment, the height is about 2.5 inches to about 4 inches. In some embodiments, the member assembly 26 comprises a width of about 3.5 inches to about 6 inches as measured between the first edge 21 and the second edge 23. In one embodiment, the member assembly 26 comprises a cross-sectional area of about 8.75 square inches to about 24 square inches as measured between the first edge 21, second edge 23, third edge 25 and fourth edge. In one embodiment, the member assembly 26 comprises a length of about 15.5 inches to about 17 inches. In one embodiment, the member assembly 26 comprises a volume of about 135 cubic inches to about 425 cubic inches.

In some embodiments, the base 22 is configured to be coupled to a wheelchair support base (not shown) such that the platform lift mechanism base 22 is fixed relative to the wheelchair support base. In some embodiments, the base 22 is fixed relative to the wheelchair support and is configured to allow a member assembly 26 to rotate relative to the base 22, as explained in greater detail below.

Figure 4:
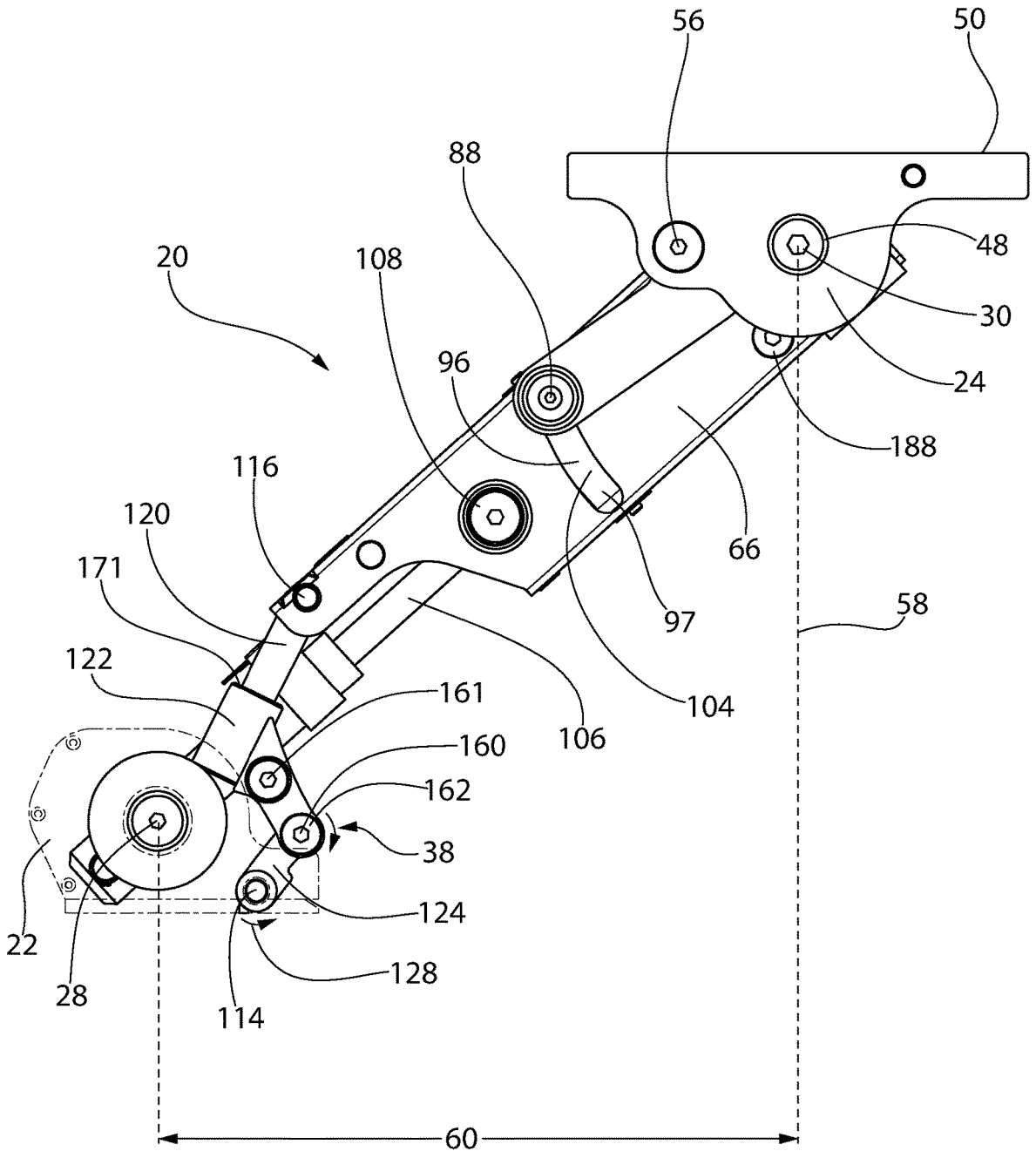
FIG. 4 is a side view of the lift mechanism of FIG. 2 with some components removed to reveal internal components.
Figure 5:
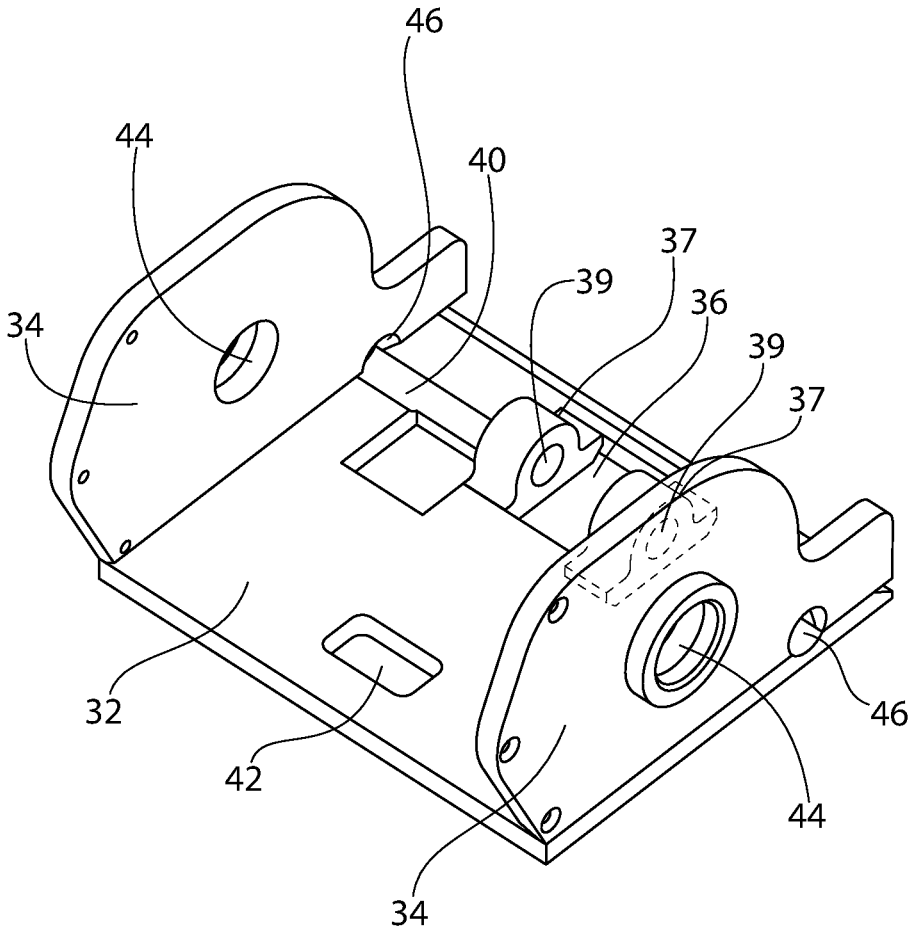
FIG. 5 is a top, side perspective view of a base in accordance with one embodiment of the present invention.

FIG. 5 illustrates an exemplary embodiment of the base 22. In some embodiments, the base 22 comprises a base plate 32 with sidewalls 34 coupled to the base plate. In some embodiments, the base plate 32 is coupled to the wheelchair base (not shown) via adhesive, welding, fasteners, etc. In some embodiments, the base plate comprises an opening 36 configured to receive at least a portion of a lifting link assembly (best seen in FIG. 4) when the platform lift mechanism is in the lowered configuration (FIG. 1). In some embodiments, positioning a portion of the lifting link assembly 38 within the opening 36 reduces the spatial footprint of the lift mechanism 20 compared to a system which does not include such an opening. In some embodiments, the base plate comprises a reduced thickness portion 40. In some embodiments, the reduced thickness portion 40 comprises a groove configured to receive a portion of the lifting link assembly 38 as explained in greater detail below. In some embodiments, the base plate 32 comprises an accessway 42.

Figure 12:
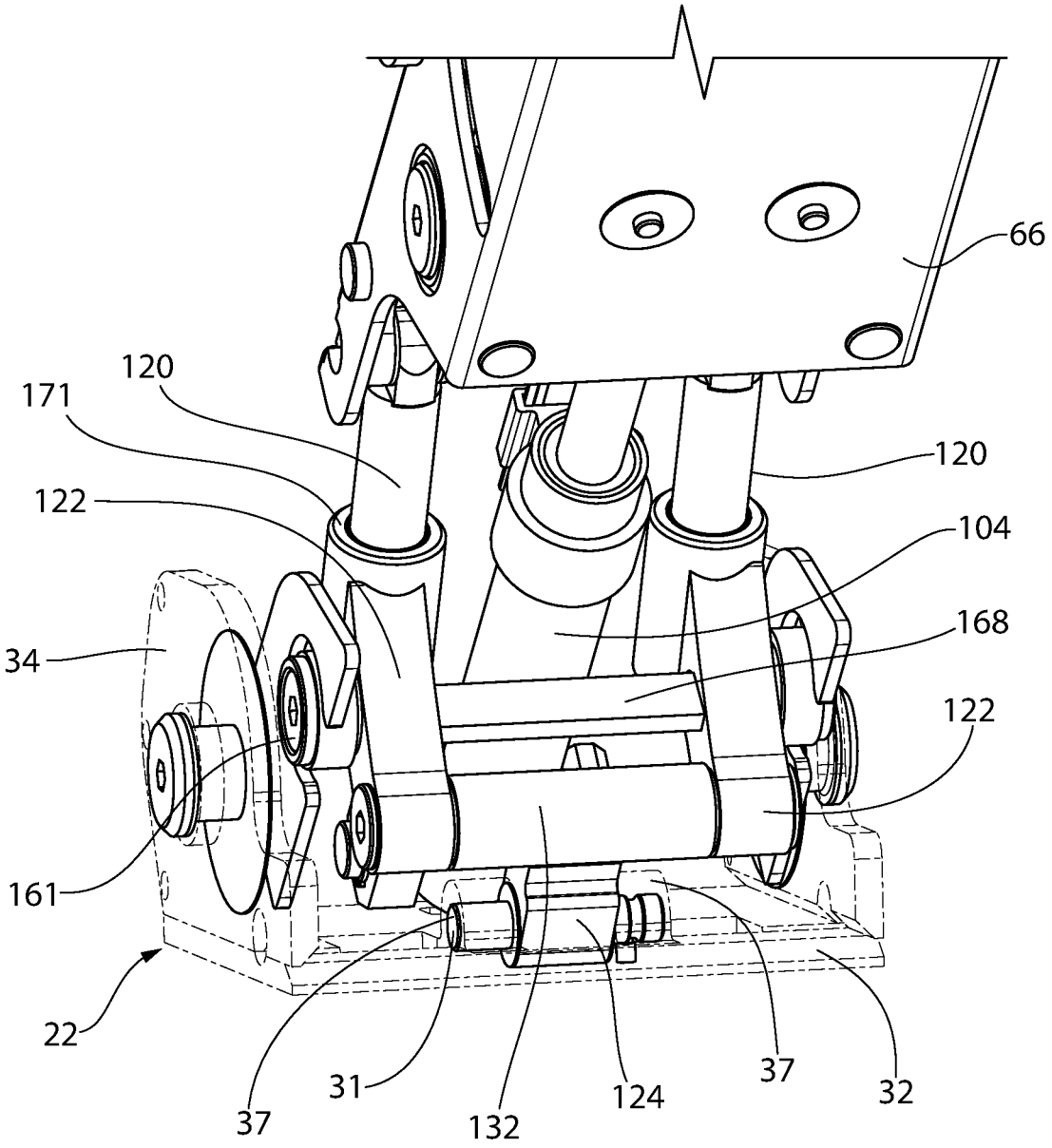
FIG. 12 is a front, side perspective view of the lift mechanism of FIG. 2 with some components removed to reveal internal components.

Still referring to FIG. 5, in some embodiments, one or more lugs 37 are coupled to the base plate 32 to secure the rotatably couple the lifting link assembly 38 to the base 22. In some embodiments, a lug opening 39 extends through each lug 37 and is configured to receive a base link pivot 31 (best seen in FIG. 2) such that a lifting link assembly can rotate about the base link pivot with respect to the base as explained in greater detail below. In some embodiments, the base 22 comprises a pair of lugs 37 and the lug opening 39 of each lug are collinear such that a common pivot extends through both lug openings to secure the lifting link assembly 38 to the base 22 as best seen in FIG. 12. In some embodiments, the lug 37 and base plate 32 are a monolithic construct. In some embodiments, the lug 37 is connected to a wheelchair base independently of the base plate 32.

Still referring to FIG. 5, in some embodiments, the sidewall 34 comprises a bearing opening 44 configured to receive a base pivot 28 as explained in greater detail below. In some embodiments, a pair of sidewalls 34 extend away from the base plate 32 and oppose each other such that the bearing opening 44 of each sidewall are coaxial. In some embodiments, a common shaft (not shown) extends through each bearing opening 44 and rotatably couples the member assembly 26 to the base 22. In some embodiments, the bearing opening 44 includes a centerpoint about which the member assembly 26 rotates as the platform lift mechanism is moved from the lowered configuration to the raised configuration.

In some embodiments, a link bearing opening 46 extends through the sidewall 34. In some embodiments, the link bearing opening 46 includes a boundary defined by a semi-circular shape. In some embodiments, the link bearing opening 46 is aligned with the groove 40 in the base plate 32 such that a shaft (not shown) coupled to the lifting link assembly 38 is received in the link bearing opening 46 and can rotate therein as the lift mechanism rotates. In some embodiments, the link bearing opening 46 provides access to a pivot which connects the lifting link assembly 38 to the lugs 37. In one embodiment, the sidewall 34 comprises an L-shape with a bottom portion extending the width of the base plate 32 an allowing access to pivot 161 when the lift mechanism 20 is in the elevated configuration.

In some embodiments, the platform mount 24 is configured to be attached to a seat of a wheelchair (not shown) such that the seat is elevated as platform lift mechanism moves from the lowered configuration (FIG. 1) to the raised configuration (FIG. 2). FIGS. 1-4 illustrate an exemplary embodiment of the platform mount 24. In some embodiments, the platform mount 24 includes a pivot opening 48 configured to receive a platform pivot 30 which couples the platform mount 24 to the member assembly 26 such that the platform mount 24 can rotate or pivot relative to the member assembly 26 (e.g., as the lift mechanism is raised or lowered). In some embodiments, a pivot couples members or elements of the lift mechanism 20 (e.g., the member assembly 26 and base 22, the member assembly 26 and the platform mount 24, the lifting link assembly 28) to each other such that the elements can rotate relative to each other. In some embodiments, a pivot comprises one or more of a shaft, an axle, a shoulder screw, a rod, a dowel or other construct which couples elements to each other and allows relative rotation therebetween. In some embodiments, the platform mount 24 includes a link assembly aperture 54 configured to receive a platform link pivot 56. In some embodiments, the platform link pivot 56 couples the platform mount 24 to a platform link assembly 52 (best seen in FIG. 13). In one embodiment, platform mount 24 comprises a curved lower border. In some embodiments, the curved lower border allows the platform mount 24 to rotate relative to the second member 66 with minimal protrusion outside of a plane including the lower surface or the second member when the lift mechanism 20 is in the elevated configuration.

Figure 3:
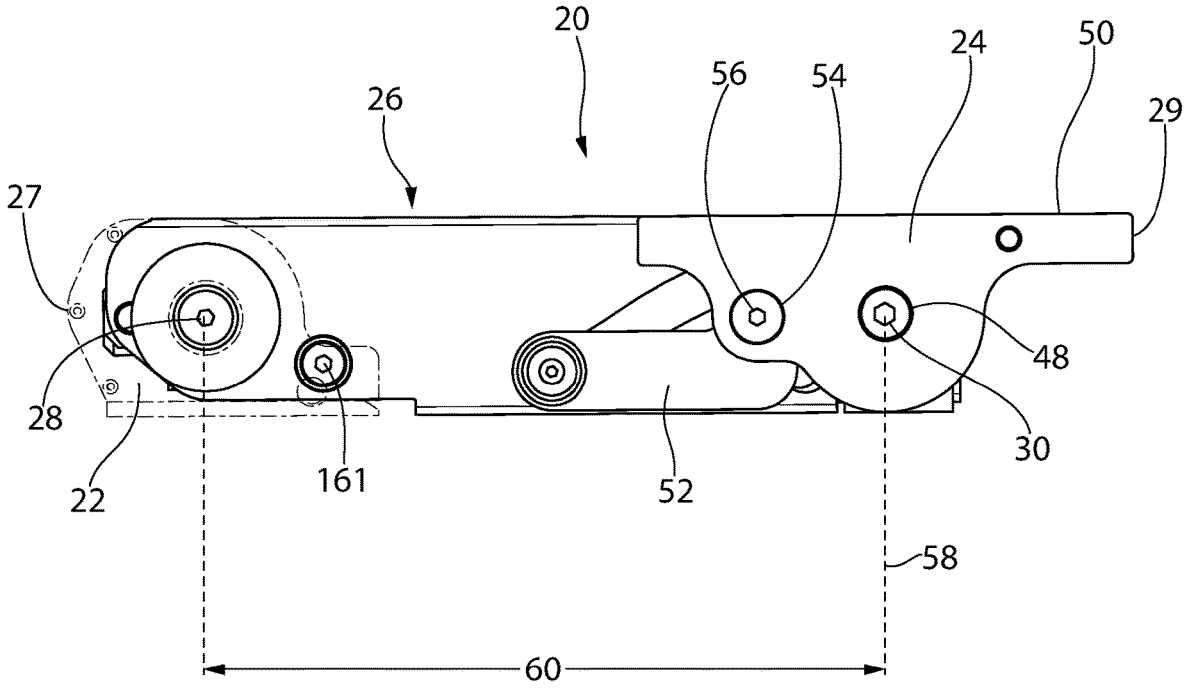
FIG. 3 is a side view of the lift mechanism of FIG. 1.

In some embodiments, the platform mount 24 includes an upper surface 50 which may be adjacent or parallel to bottom surface of a seat of a wheelchair and/or a tilt/recline mechanism of a wheelchair (not shown). In some embodiments, the platform link assembly 52 is configured to maintain an orientation of the upper surface 50 with respect to the horizon as explained in greater detail below. In some embodiments, the orientation of the platform includes an orientation of an aspect of the platform mount 24 (e.g., upper surface 50, a side surface) with respect to the horizon. In one embodiment, the orientation of the platform mount 24 includes an orientation of an aspect of the platform mount 24 relative to a vertical plane passing through the mount along axis 58 (FIGS. 3-4). In some embodiments, the upper surface 50 is oriented parallel to a horizon as the lift mechanism 20 moves from the lowered configuration to the raised configuration including, for example, as lift mechanism 20 pivots or rotates relative to the base 22, as it expands in length by telescoping or otherwise. In some embodiments, the upper surface 50 is parallel to a bottom surface of the base plate 32. In some embodiments, the upper surface 50 is co-planar with a top surface of the member assembly 26 when the lift mechanism 20 is in the lowered configuration (best seen in FIG. 3). In some embodiments, the orientation of the upper surface 50 in the lowered configuration varies from the orientation of the upper surface 50 in the elevated configuration by less than 10 degrees, less than 9 degrees, less than 8 degrees, less than 7 degrees, less than 6 degrees, less than 5 degrees, less than 4 degrees, less than 3 degrees, less than 2 degrees, or less than 1 degree. In some embodiments, the lift mechanism 20 includes two platform mounts 24 on opposing sides of the member assembly 26. In some embodiments, a cross member 62 (best seen in FIG. 1) extends between the two opposing platform mounts 24 to maintain the alignment of the platform mounts relative to each other and provide a more rigid structure than a structure that does not include a cross member.

In some embodiments, the platform lift mechanism 20 includes an extending means for extending lift mechanism 20 as described herein. In one embodiment, extending means is member assembly 26. Member assembly 26 may be configured to rotate or pivot relative to the base 22 to elevate the platform mount 24 as the lift mechanism 20 moves from the lowered configuration to the raised configuration. FIGS. 1-4 illustrate an exemplary embodiment of the member assembly 26. In one embodiment, the member assembly 26 is rotatably coupled to the base 22 at a base pivot point 28 such that the member assembly 26 rotates about the base pivot point 28. In one embodiment, the member assembly 26 is coupled to the base 22 by a base pivot such that the alignment of the member assembly 26 relative to the base 22 is maintained while allowing the member assembly 26 to rotate relative to the base 22. In some embodiments, the member assembly 26 is coupled to the platform mount 24 by a platform pivot 30 such that the platform mount 24 can rotate relative to the member assembly 26 as the member assembly 26 moves relative to the base 22. In some embodiments, the base 22 is configured to rotate relative to a wheelchair base (not shown) about axis 33 (FIG. 1). In some embodiments, the member assembly 26 is configured to rotate relative to the base 22 about the base pivot point 28 while the base 22 rotates relative to the wheelchair base about axis 33. In some embodiments, the member assembly 26 is configured to rotate relative to the base 22 about the base pivot point 28 while the base 22 rotates relative to the wheelchair base about axis 33, while the member assembly 26 expands telescopically or otherwise. In one embodiment, the base plate 32 is rotationally fixed relative to the wheelchair base and the member assembly 26 and base sidewalls 34 are configured to rotate relative to the base plate 32 about axis 33.

Figure 6:
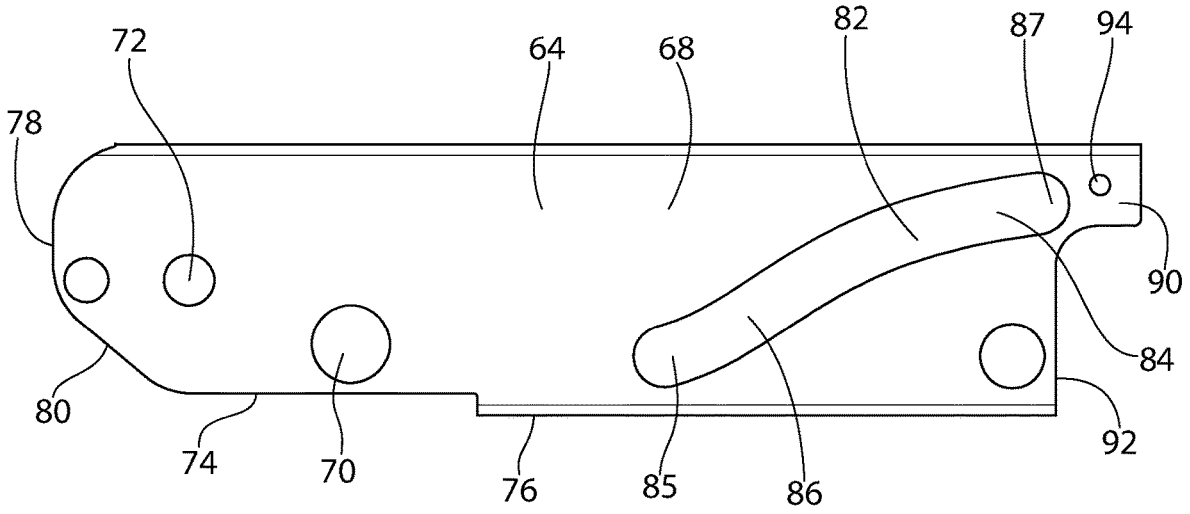
FIG. 6 is a side view of a first member in accordance with one embodiment of the present invention.
Figure 7:
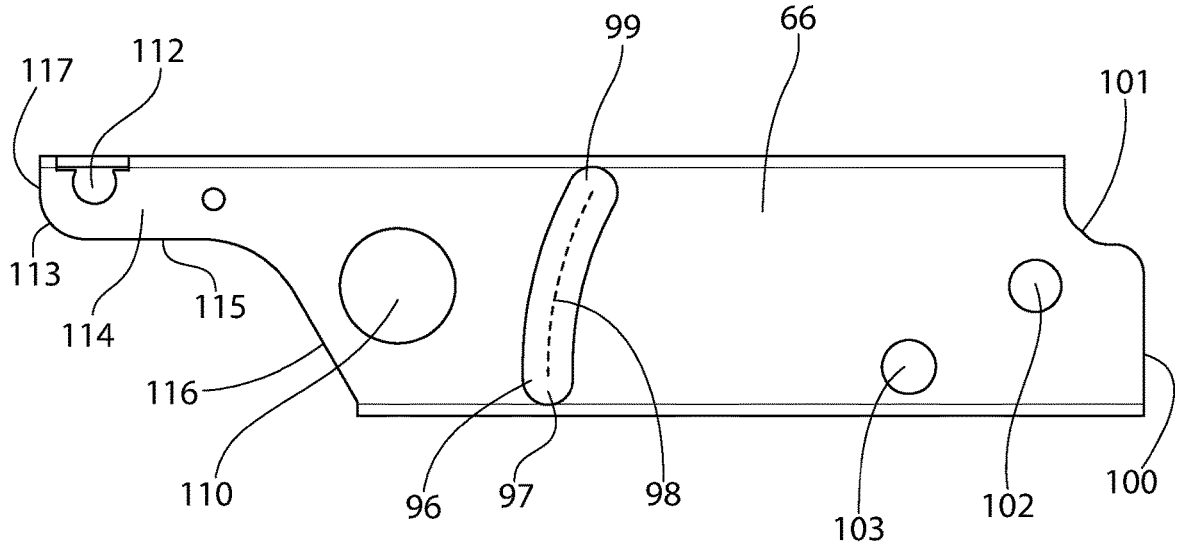
FIG. 7 is a side view of a second member in accordance with one embodiment of the present invention.

In some embodiments, the member assembly 26 comprises one or more nested members that telescopically expand. The member assembly 26 may include two members, as illustrated herein. In some embodiments, the member assembly 26 includes more than two members. In some embodiments, the member assembly 26 comprises a first member 64 (FIG. 6) and a second member 66 (FIG. 7). In some embodiments, the first member 64 and second member 66 are moveable with respect to each other. In some embodiments, the second member 66 is translatable with respect to the first member 64 along a longitudinal axis of the second member (not shown). In one embodiment, the second member 66 is rotatable with respect to the first member 64 about the longitudinal axis of the second member 66. In one embodiment, the first member 64 and second member 66 are threadingly engaged such that relative rotation between the first member 64 and the second member 66 causes axial movement of the second member 66 relative to the first member 64. In some embodiments, the second member 66 is in sliding engagement with the first member 64 and the movement of the second member 66 is guided by the first member 64 such as by telescoping in a confined tolerance (e.g., one member is nested within the other). In some embodiments, relative movement of the second member 66 with respect to the first member 64 is created by forces acting on the second member 66 to cause the second member to move in a guided fashion relative to the first member 64.

In one embodiment, lifting link assembly 28 is rotatably coupled to the first member 64. In some embodiments, the first member 64 is rotatably coupled to the base 22 such that as the second member 66 moves relative to the first member 64, the lifting link assembly 28 causes the first member 64 to rotate relative to the base 22, as explained in greater detail below. In one embodiment, the first member 64, as shown in FIGS. 1 and 6, comprises a sidewall 68 including a through hole 70. In one embodiment, the through hole 70 is configured to receive a pivot 161 which rotatably couples the first member 64 to the lifting link assembly 28. In one embodiment, the first member 64 includes a rear opening 72 configured to receive the base pivot 28. In some embodiments, the first member 64 rotates about the center point of rear opening 72 (e.g., as the lift mechanism 20 moves from the lowered configuration to the elevated configuration). In some embodiments, the first member 64 comprises a lower surface 76 configured to be co-planar with the bottom surface of the base plate 32 when the lift mechanism 20 is in the lowered configuration. In some embodiments, the first member 64 comprises a recessed surface 74 adapted to be adjacent to, or contiguous with, the top surface of the base plate 32 (e.g., when the lift mechanism 20 is in the lowered configuration). In some embodiments, the first member 64 includes a transition 80 between the recessed surface 74 and a rear edge 78. In one embodiment, the transition 80 is defined by a chamfer, fillet, or arc portion of a circle such that the first member 64 can rotate relative to the base 22 without contacting the base plate 32 as the first member rotates, thereby providing a more compact design than a system which does not include such a transition.

In some embodiments, the first member 64 includes a guiding means for guiding the platform link assembly 52 in a manner that enables platform mount 24 to retain its orientation as lift mechanism 20 operates. In some embodiment, guiding means is a track (e.g., first track 82, second track 96 or combinations thereof), or a slot. First track 82 may be configured to receive a journal 88 coupled to the platform link assembly 52 in a configuration that maintains the orientation of the platform mount 24. In one embodiment, the first track 82 comprises a slot configured to guide the movement of the journal 88 as the lift mechanism 20 moves from the lowered configuration to the raised configuration. In one embodiment, the first track 82 comprises a first portion 84 connected to a second portion 86. In one embodiment, the first portion 84 comprises an arcuate shape and is concave with respect to the lower surface 76 of the first member 64. In one embodiment, the second portion 86 comprises an arcuate shape and is convex with respect to the lower surface 76 of the first member 64. In some embodiments, the shape of the first track 82 controls the orientation of the upper surface 50 of the platform mount 24, as explained in greater detail below. In one embodiment, the track 82 comprises a first region 85 and a second region 87. In one embodiment, the journal 88 is configured to be in the first region 85 when the lift mechanism 20 is in the lowered configuration and in the second region 87 when the lift mechanism 20 is in the elevated configuration. In some embodiments, the first member 64 includes a protrusion 90 extending from a front wall 92. In one embodiment, at least a portion of the first track 82 is positioned in the protrusion such that the first track 82 extends forward of the front wall 92. In one embodiment, the protrusion 90 includes a mounting hole 94. In one embodiment, the mounting hole 94 is configured to receive an anchor, screw, etc. to secure a spacer (not shown) to the hollow interior of the first member to maintain the alignment of the first member 64 and second member 66 relative to each other as they move.

In some embodiments, the lift mechanism 20 includes a second track means for influencing rotation of a platform link assembly. In some embodiments, the second track means receives the journal 88 to influence the rotation of the platform link assembly 52 relative to the second member 66 and maintain the orientation of the platform mount. In some embodiments, the second track means comprises a second track 96. Turning now to FIG. 7, in some embodiments, the second member 66 includes the second track 96 defined by a median axis 98 having an arcuate shape. In one embodiment, the second track 96 is transverse to the first track 82. In some embodiments, the first track 82 intersects the second track 96 (e.g., when the lift mechanism 20 is in the lowered configuration, the raised configuration, and/or at any point in between the lowered and raised configurations). In some embodiments, the first track 82 and the second track 96 are configured to receive the journal 88 (e.g., such that the journal travels along both tracks simultaneously as the first member 64 rotates relative to the base 22). In one embodiment, the second track 96 is concave relative to a front edge 100 of the second member 66. In one embodiment, the second member 66 comprises a transition (e.g. a radius) between border portions (e.g. bottom and front or rear walls) which provides greater clearance (e.g. for seat interface bolts) when rotating than a design which does not include such a transition. In one embodiment, the track 96 comprises a lower portion 97 and an upper portion 99. In one embodiment, the journal 88 is configured to be in the lower portion 97 when the lift mechanism 20 is in the lowered configuration (FIG. 8) and in the upper portion 99 when the lift mechanism is in the elevated configuration (FIG. 4). In one embodiment, the journal 88 is configured to be in the first region 85 of the first track 82 and the lower portion 97 of the second track 96 when the lift mechanism 20 is in the lowered configuration (FIG. 1). In one embodiment, the journal 88 is configured to be in the second region 87 of the first track 82 and the upper portion 99 of the second track 96 when the lift mechanism 20 is in the elevated configuration (FIG. 2).

Still referring to FIG. 7, in some embodiments, the second member 66 includes a mounting hole 102. Mounting holes 102 may be configured to couple to a motor or actuator (e.g., that acts upon second member 66 to move second member 66 relative to first member 64). In some embodiments, a motor or actuator 104 is mounted within the second member 66 and is secured to the second member via anchors, screws, etc. via the mounting holes 102 as explained below. In one embodiment, the platform pivot 30 is received in the mounting hole 102 such that the platform pivot secures the actuator platform assembly 181 (FIG. 13) to the second member 66 and allows the platform link assembly 52 to rotate about the platform pivot 30 as explained in greater detail below. In one embodiment, the second member 66 includes a second member link opening 103 and is configured to receive a second member link pivot as explained in greater detail below. In some embodiments, a gearbox (not shown) is coupled to the actuator 104 (e.g., within an internal cavity of the second member 66). In some embodiments, the gearbox is coupled to the second member 66 via an anchor 108 (FIG. 4) within an anchor opening 110. In some embodiments, the actuator 104 includes a shaft 106 and is coupled to each of the first member 64 and the second member 66 such that the actuator 104 moves the second member relative to the first member when the actuator is activated. In some embodiments, a lifting link assembly pivot opening 112 is formed in an extension 114 of the second member 66. In one embodiment, the extension 114 extends rearwardly from a back wall 116 of the second member 66. In one embodiment, the extension 114 comprises a transition 113 between a lower surface 115 and rear wall 117. In one embodiment, transition 113 is defined by an arcuate portion of a circle having a radius. In one embodiment, the radius provides more clearance as the extension 114 rotates relative to the front edge 171 of the cap 166 of the receiving link 124 than an extension having a squared or non-arcuate transition. In one embodiment, the extension 114 allows the second member 66 to be coupled to the lifting link assembly 38 without interference from the body of the second member 66.

In some embodiments, one of the first member 64 and the second member 66 is at least partially nested within the other of the first member 64 and the second member 66 such that the second member 66 telescopically extends away from the first member 64 as the lift mechanism 20 moves from the lowered configuration to the raised configuration. In one embodiment, an actuator 104 is coupled to one or both of first member 64 and second member 66. In one embodiment, the actuator 104 comprises a hydraulic piston within a cylinder. In one embodiment, the actuator 104 comprises a threaded rod with a motor attached. In some embodiments, the actuator 104 moves the second member 66 relative to the first member 64 from a first position (FIG. 1) to a second position (FIG. 2) such that the member assembly 26 expands as the lift mechanism 20 moves from the lowered configuration to the raised configuration. In one embodiment, the actuator 104 is configured to move the lift mechanism 20 from the lowered configuration to the raised configuration in less than 45 seconds.

Turning now to FIGS. 3-4, in some embodiments, the platform mount 24 includes a center of gravity at the pivot opening 48. In some embodiments, the center of gravity of the platform mount 24 remains at a substantially fixed horizontal distance 60 from a base pivot point 28 where the member assembly 26 is pivotably mounted to the base 22 as the lift mechanism 20 moves from the lowered configuration to the raised configuration. In some embodiments, the member assembly 26 is configured to expand as the member assembly rotates to maintain the center of gravity of the platform mount at the fixed horizontal distance. In one embodiment, the platform mount 24 lies within a vertical plane defined by vertical axis 58 when the platform mount is in the lowered position and the platform mount moves a maximum of two inches from the vertical plane as the first member 64 rotates relative to the base 22.

Some embodiments include a lifting link means for moving a member assembly during operation of a lift mechanism. In some embodiments, a lifting link means is configured to move (e.g., lift or lower) member assembly 26 during operation of the lift mechanism 20. In some embodiments, the lifting means is configured to rotate the first member 64 with respect to the base 22 as the second member 66 moves relative to the first member 64. Lifting link means in one embodiment is lifting link assembly 38. FIGS. 4 and 12 illustrate an exemplary embodiment of the lifting link assembly 38. In some embodiments, the lifting link assembly 38 rotates the member assembly 26 relative to the base 22 to move the lift mechanism 20 from the lowered configuration to the raised configuration as the second member 66 moves relative to the first member 64. In some embodiments, a base link pivot 114 couples the lifting link assembly 38 is coupled to the base 22 (e.g., such that the lifting link assembly can rotate relative to the base 22). In some embodiments, the lifting link assembly 38 is coupled to the member assembly 26 by a lifting link pivot 116 such that the lifting link assembly 38 is rotatable with respect to the member assembly 26 about an axis defined by the lifting link pivot 116.

In some embodiments, the lifting link assembly 38 is coupled to the base 22 and the second member 64 of the member assembly 26 (e.g., such that the lifting link assembly 38 rotates relative to the first member 64, the second member 66, and the base 22 as the second member moves relative to the first member, thereby causing the first member 64 to rotate relative to the base 22).

Figure 8:
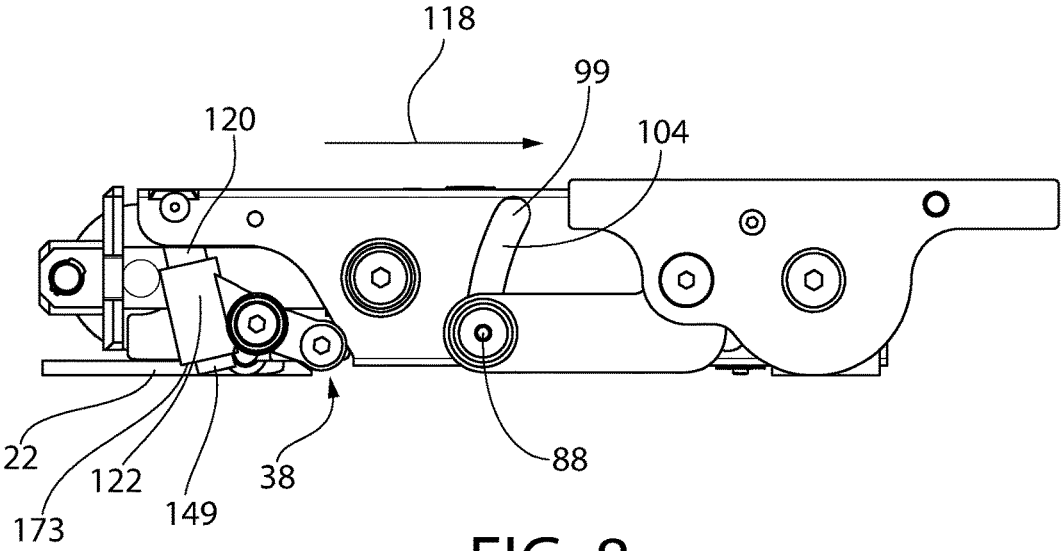
FIG. 8 is a side view of the lift mechanism of FIG. 1 with some components removed to show internal components.

In some embodiments, the lifting link assembly 38 is folded upon itself when the lift mechanism is in the lowered configuration (e.g., the lifting link assembly includes hinges such that portions of the lifting link assembly are adjacent other portions of the lifting link assembly as best seen in FIG. 8). Although the first member is not shown in FIG. 8, in some embodiments the second member 66 moves along direction 118 while the base 22 and the first member remain stationary with respect to direction 118. In some embodiments, the lifting link assembly 38 unfolds as the first member 64 moves relative to the second member 66 such that the first member 64 rotates relative to the base 22. In some embodiments, the lifting link assembly 38 comprises a lifting link 120, a receiving link 122, and a base link 124 as best seen in FIG. 4. In some embodiments, the lifting link assembly 38 comprises one base link 124, two receiving links 122, and two lifting links 120.

Figure 9:
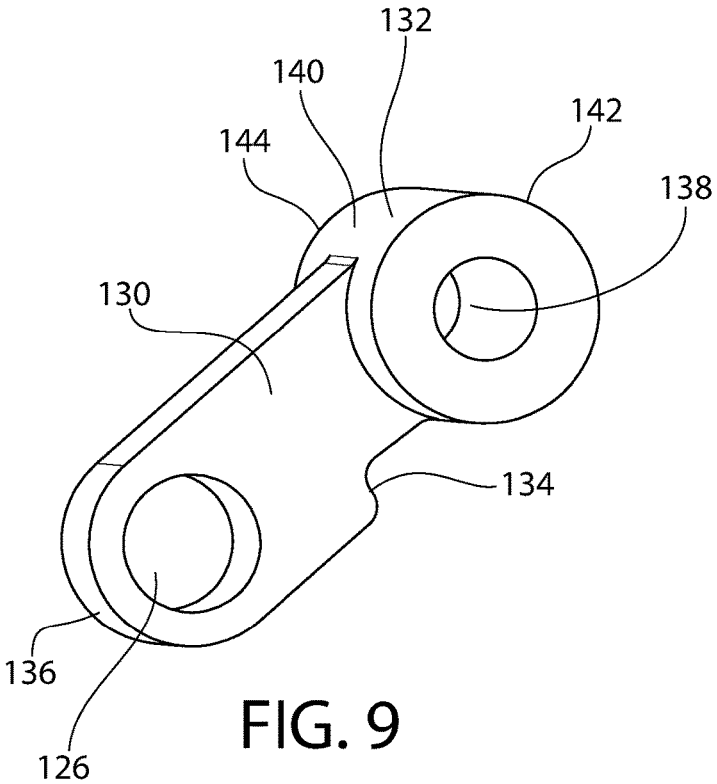
FIG. 9 is a top, side perspective view of a base link in accordance with one embodiment of the present invention.

In some embodiments, there is a base link means for rotating the lifting means relative to the base 22. Base link means, in one embodiment, is base link 124. FIG. 9 illustrates an exemplary embodiment of a base link 124. In some embodiments, the base link 124 includes a base link pivot opening 126 configured to receive the base link pivot 114. In some embodiments, the base link pivot 114 couples the base link 124 to the base 22. In some embodiments, the base link 124 is configured to rotate about the base link pivot 114 in a base link rotation direction 128 (FIG. 4) as the lift mechanism 20 moves from the lowered configuration to the elevated configuration. In some embodiments, the base link 124 comprises a first portion 130 and a second portion 132. In one embodiment, the first portion 130 includes a lower border 133 and an upper border 135 with a lip 134 forming a step-like transition between the lower border 133 and the upper border 135. In one embodiment, the lower border 133 is configured to be positioned in the opening 36 of the base plate 32 when the lift mechanism 20 is in the lowered configuration. In one embodiment, the first portion 130 includes a rear surface 136 defined by an arcuate portion of a circle having a centerpoint collinear with the center of the base link pivot opening 126.

In one embodiment, the second portion 132 comprises a central opening 138 configured to receive a receiving link pivot such that the receiving link 122 rotates relative to the base link as the lift mechanism 20 moves from the lowered configuration to the raised configuration. In one embodiment, the second portion 132 comprises an outer wall 140 having an outer shape defined by a circle having its center collinear with a center of the central opening 138. In some embodiments, the second portion 132 includes a width between a first edge 142 and a second edge 144. In some embodiments, the width of the second portion 132 is configured to provide adequate space for the actuator 104 or shaft 106 between the receiving links 122 and the lifting links 120 as best seen in FIG. 12. In one embodiment, the second portion 132 comprises a hollow cylinder configured to receive the receiving link pivot 160 (FIG. 4). In one embodiment, the base link pivot opening 126 and the central opening 138 are parallel. In one embodiment, a radius of the base link pivot opening 126 is equal to a radius of the central opening 138.

Figure 10:
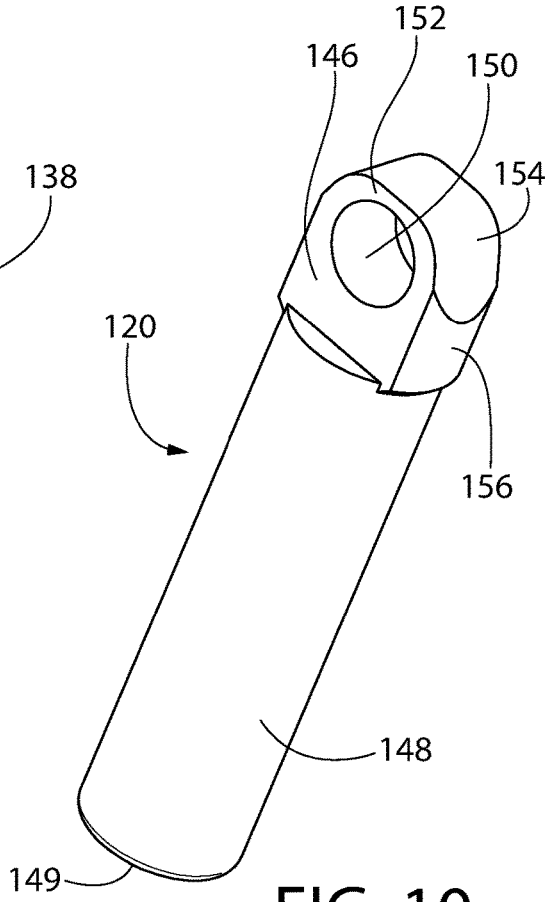
FIG. 10 is a top, side perspective view of a lifting link in accordance with one embodiment of the present invention.

An exemplary embodiment of a lifting link 120 is illustrated in FIG. 10. In one embodiment, the lifting link 120 comprises an upper portion 146 and a lower portion 148. In one embodiment, the lower portion 148 is defined by a cylindrical shape configured to be slidingly received by the receiving link 122. In one embodiment, the upper portion 146 includes a lifting link opening 150 configured to receive the lifting link pivot 116 (FIG. 4) such that the lifting link is rotatable relative to the second member 66. In one embodiment, the upper portion 146 includes a transition 154 between a top wall 152 and a side wall 156. In one embodiment, the transition 154 comprises a fillet or chamfer configured to avoid contact with the second member 66 as the lifting link 120 rotates relative to the second member.

Figure 11A:
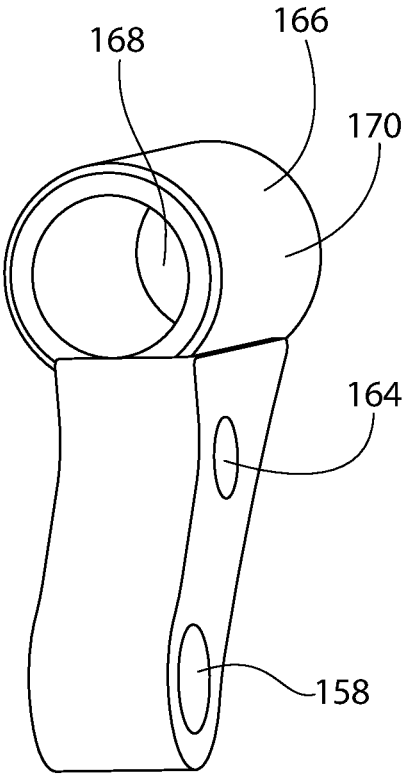
FIG. 11A is a rear, side perspective view of a receiving link in accordance with one embodiment of the present invention.
Figure 11B:
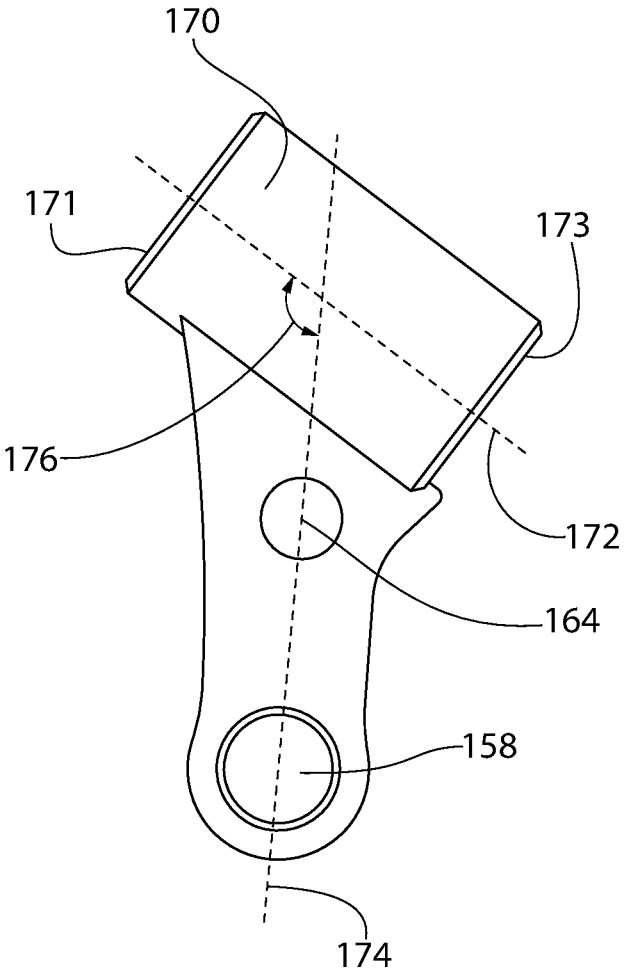
FIG. 11B is a side view of the receiving link of FIG. 11A.

In one embodiment, the lift mechanism 20 includes a receiving link means for transferring linear motion of the second member 66 into rotational motion of the lifting link means relative to the first member 64. In one embodiment, the receiving link means serves as a pivotably guide that is configured to permit the base link 124 to rotate relative to the base 22 to move the first member 64 relative to the base 22. In some embodiments, the lift mechanism 20 includes the receiving link means for allowing rotational motion of the lifting link 120 relative to the base and for varying the effective link length of the lifting link as the second member 66 moves relative to the first member 64. In one embodiment, the receiving link means is the receiving link 122. An exemplary embodiment of a receiving link 122 is illustrated in FIGS. 11A-11B. Receiving link 122 may be coupled to one or more of the base link 124 and the lifting link 120. In one embodiment, the receiving link 122 comprises a first opening 158 configured to receive the receiving link pivot 160 (e.g., such that the receiving link 122 rotates relative to the base link 124 about the receiving link pivot 160 in the receiving link pivot direction 162 as the lift mechanism 20 moves from the lowered configuration to the elevated configuration). In one embodiment, the receiving link 122 comprises a pivot opening 164 configured to receive the pivot 161 that rotatably couples the receiving link 122 to the first member 64 and couples a cross-member 168 (cross-member is best seen in FIG. 12) to the lifting link assembly 38. In one embodiment, the cross-member 168 comprises a rigid structure (e.g., a rod, a beam, tubing) that maintains the spacing and alignment of the receiving links 122 in a lifting link assembly 38 which incorporates more than one receiving link. In some embodiments, the cross-member 168 is defined by a length equal to the length of the second portion 132 of the base link 124.

In one embodiment, the receiving link 122 comprises a cap 166 with a cap opening 168 extending therethrough. In one embodiment, the cap opening 168 is configured to receive the lifting link 120. In one embodiment, cap opening 168 is configured to retain the lifting link 120 at an angle relative to axis 174 that is preselected to allow an increased amount of sliding travel while minimizing the spatial footprint of the lifting link assembly 38 when the lift mechanism 20 is in the lowered configuration compared to a perpendicular design. In one embodiment, the cap opening 168 is configured to slidingly receive the lifting link 122. In one embodiment, the cap 166 comprises an outer wall 170 disposed about an axis of symmetry 172. In one embodiment, the cap 166 comprises a length as measured between a front edge 171 and a rear edge 173. In some embodiments, the length of the cap 166 is less than the length of the lifting link 120. In one embodiment, the lifting link 120 is received in the cap opening 168 such that the lifting link is rotationally fixed relative to the receiving link 122. In one embodiment, the lifting link 120 and the receiving link 122 rotate simultaneously about at least one of the lifting link pivot 116, the pivot 161, and the receiving link pivot 160.

In one embodiment, an axis 174 extends through a center point of each of the first opening 158 and the connector opening 164 and intersects the cap axis of symmetry 172. In one embodiment, an angle 176 formed at the intersection of the axis 174 and the axis of symmetry 172 is about 0 degrees to about 90 degrees, or about 10 degrees to about 80 degrees, or about 20 degrees to about 70 degrees, or about 30 degrees to about 60 degrees, or about 40 degrees to about 50 degrees or about 45 degrees. Angle 176 is preferably selected to allow a sliding engagement between the lifting link 120 and the receiving link 122 and ensuring that sufficient force is provided by the actuator to move the lift mechanism 20. In one embodiment, the preselected angle is based on the length of lifting link 120, the cross sectional dimension of first member 66, and the distance of travel required by lifting link assembly 38, resultant moment arm forces created by the angle, In one embodiment, the lift mechanism 20 includes a lifting link means for coupling the lifting means to the first member 64 such that rotation of the receiving link, in turn causes the first member 64 to rotate relative to the base 22. In one embodiment, the load to be raised or lowered by the lift mechanism 20 and the length of the first member 64 influence the material selection and dimensions of the lifting link means. In one embodiment, the lifting link means is the lifting link 120. FIG. 10 illustrates an exemplary embodiment of the lifting link 120. In one embodiment, the lifting link 120 comprises an effective link length as measured between a center of the lifting link opening 150 and the front edge 171 of the cap 166. In one embodiment, the effective link length of the lifting link 120 changes as the lifting slide 120 slides within the cap opening 168 as the lift mechanism 20 moves from the lowered configuration to the elevated configuration. In one embodiment, the effective link length initially decreases as the second member 66 moves relative to the first member 64 and the first member rotates relative to the base 22. As the second member 66 continues to move, the effective link length begins to increase as the first member 64 continues to rotate relative to the base 22 such that the effective link length is greater when the lift mechanism is in the elevated configuration than in the lowered configuration. In one embodiment, an end 149 of the lifting link 120 extends through the cap opening 168 beyond the rear edge 173 of the cap 166 when the lift mechanism 20 is in the lowered configuration, as best seen in FIG. 8. In one embodiment, the end 149 of the lifting link 120 does not extend beyond the rear edge 173 of the cap 166 when the lift mechanism 20 is in the elevated configuration, as best seen in FIG. 4.

In one embodiment, the lifting link assembly 38 rotates relative to each of the base 22, the first member 64, and the second member 66 to cause the first member 64 to rotate relative to the base 22. In one embodiment, the lifting link assembly 38 includes a base link 124 rotatably coupled to the base 22. In one embodiment, the lifting link assembly 38 includes a lifting link 120 rotatably coupled to the second member 66. In one embodiment, the lifting link assembly 38 includes a receiving link 122 coupled to each of the base link 124 and the lifting link 120, wherein the receiving link 122 rotates relative to the base link 124 and the first member 64 as the lifting link 120 rotates relative to the second member 64, thereby causing the first member 64 to rotate relative to the base 22. In one embodiment, the first member 64 includes a cavity and the second member 66, lifting link 120, receiving link 122, and base link 124 are at least partially within the cavity when the lift mechanism 20 is in the lowered configuration.

Figure 13:
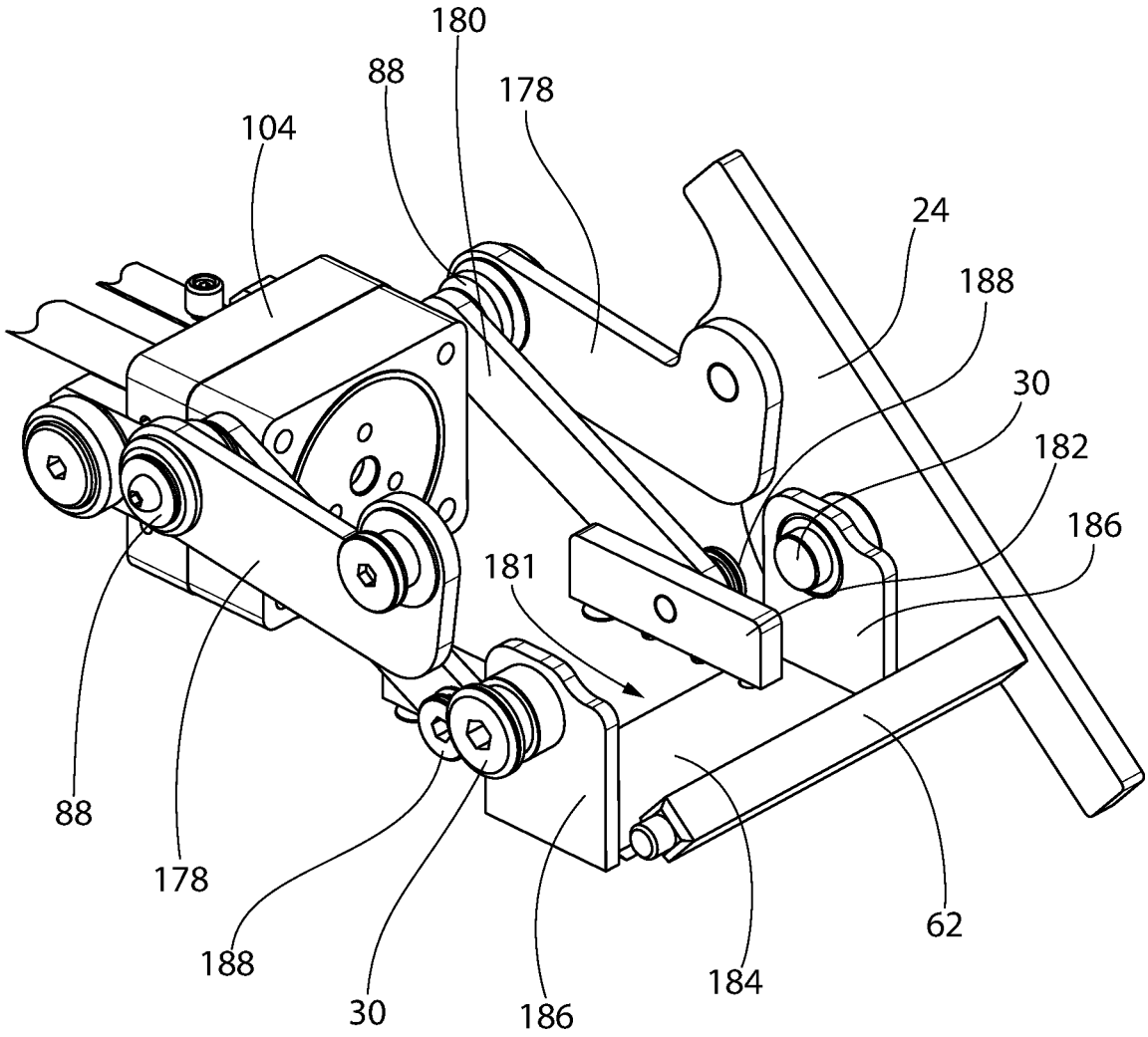
FIG. 13 is a top, side perspective view of a platform link assembly and an actuator mount assembly in accordance with one embodiment of the present invention.
Figure 14:
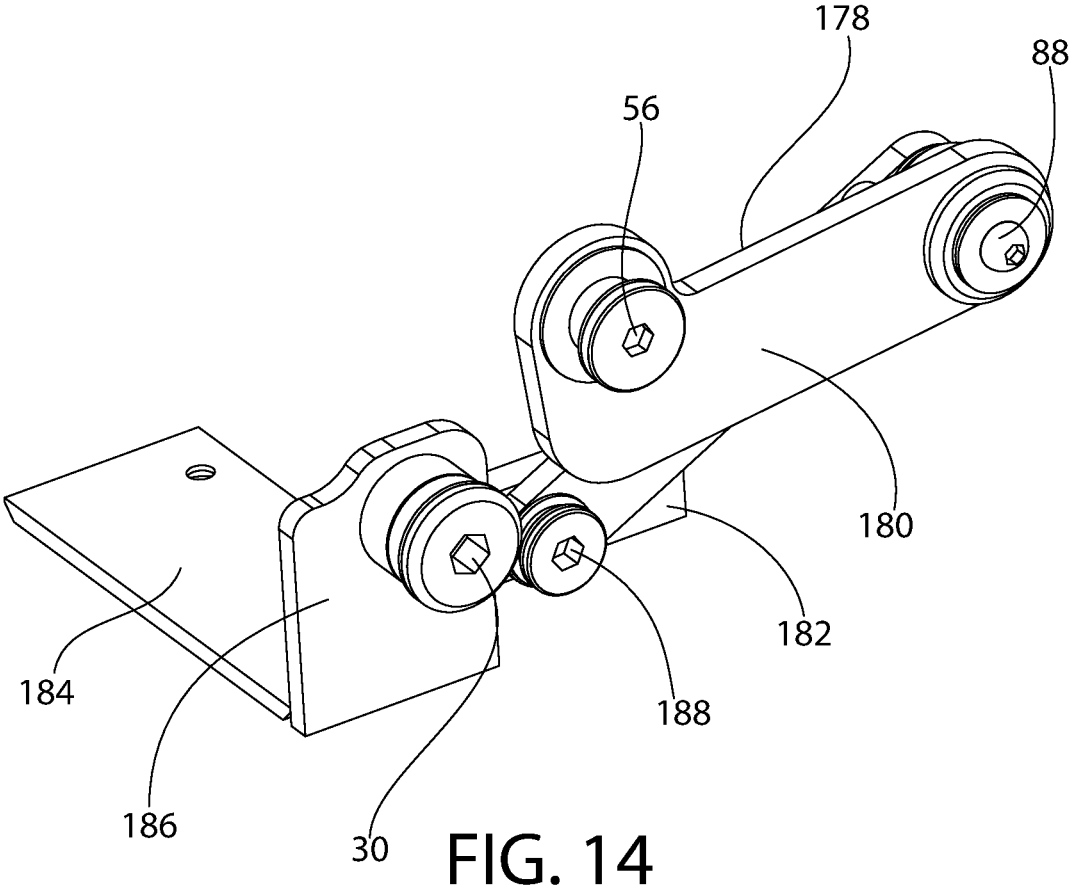
FIG. 14 is a top, side perspective view of the platform link assembly and actuator mount assembly of FIG. 13.

In one embodiment, the lift mechanism 20 includes a platform linkage means for maintaining an orientation of the platform mount with respect to the horizon. In one embodiment, the platform linkage means is coupled to each of the second member 64 and the platform mount 24 such that rotation of one of the second member 64 and the platform mount 24 relative to the platform linkage means causes rotation of the other of the second member 64 and the platform mount 24 relative to the platform linkage means. In one embodiment, the platform linkage means is a platform link assembly 52. FIGS. 13-14 illustrate an exemplary embodiment of the platform link assembly 52 with portions of the actuator 104 and the second member 66 removed for ease of illustration but their positions are apparent when viewed in conjunction with other Figs. of the present disclosure (e.g., FIGS. 1, 2, and 7). In one embodiment, the platform link assembly 52 comprises a platform link 178 and a second member link 180 each configured to be rotatable relative to each of the platform mount 24, the second member 66, and each other. In one embodiment, the platform link assembly 52 is coupled to an actuator mount assembly 181 comprising an actuator mount member 182, an actuator platform 184, and an actuator platform sidewall 186.

In one embodiment, the lift mechanism 20 includes an actuator mount means for fixedly coupling the actuator 104 to the second member 66. In one embodiment, the actuator mount means is the actuator mount assembly 181. Still referring to FIG. 13, in one embodiment, the actuator platform 184 is configured to support the actuator 104. In one embodiment, the actuator platform 184 is fixed to an actuator platform sidewall 186 and the platform pivot 30 is received in the mounting hole 102 of the second member (FIG. 7) to couple the actuator platform sidewall 186 to the second member 66. In one embodiment, a second member link pivot 188 is configured to be received in the second member link opening 103 of the second member 66 (FIG. 7) to couple the actuator mount member 182 to the second member 66. In one embodiment, the actuator platform sidewall 186, the actuator platform 182, and the actuator mount member 182, are each fixed relative to each other to prevent relative rotation therebetween. In one embodiment, the actuator mount assembly 181 is fixed to the second member at two locations on each opposing sidewall of the second member 66 such that the actuator mount assembly 181 is fixed to the second member 66 and relative rotation between the two is prevented.

Figure 15:
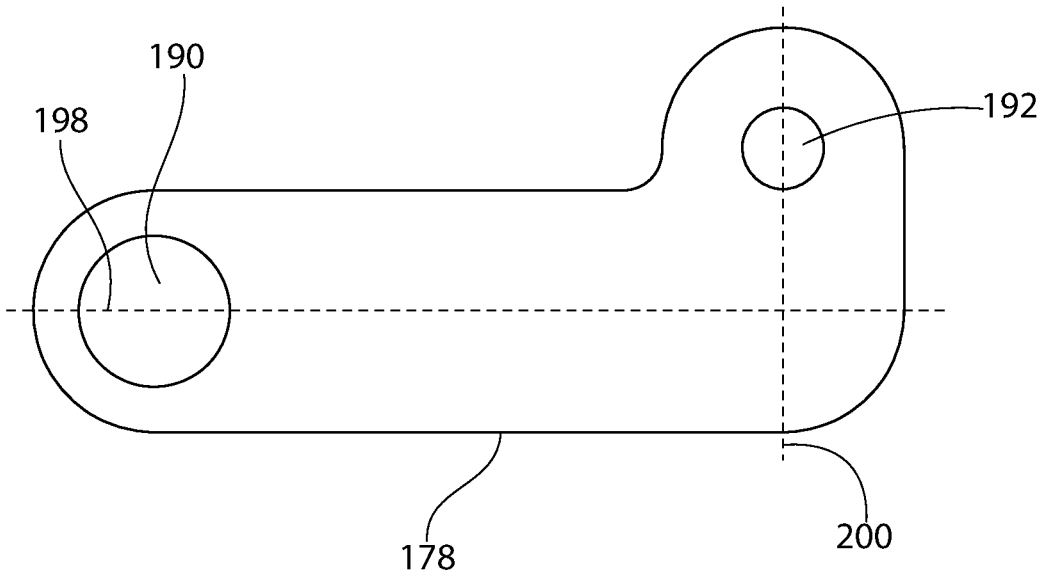
FIG. 15 is a side view of a platform link in accordance with one embodiment of the present invention.

In one embodiment of the lift mechanism 20, there is a platform link 178. Platform link 178 may be coupled to the platform mount 24, the first member 64, and the second member 66 (e.g., such that the relative linear motion of the second member 66 causes the platform mount 24 to rotate relative to the second member 66). FIG. 15 illustrates an exemplary embodiment of the platform link 178. In one embodiment, the platform link 178 comprises a main portion 194 with a protrusion 196 extending from the main portion. In one embodiment, the platform link comprises an L-shaped link. In one embodiment, the platform link includes a first platform link opening 190 in the main portion 194 and a second platform link opening 192 in the protrusion 196. In one embodiment, the main portion 194 includes a longitudinal axis 198. In one embodiment, the protrusion 196 includes a longitudinal axis 200. In one embodiment, the main portion longitudinal axis 198 is transverse to the protrusion longitudinal axis 200. In one embodiment, the main portion longitudinal axis 198 is perpendicular to the protrusion longitudinal axis 200. In one embodiment, offsetting the second platform opening 192 from the main portion longitudinal axis 198 provides a moment arm to generate additional force as the platform link 178 is rotated.

Referring again to FIGS. 13-14, in one embodiment the second member link 180 comprises a rigid member configured to be rotatably coupled to each of the second member link pivot 188 and the journal 88. For example, the second member link 180 may include openings to receive each of the pivot 188 and the journal 88. In one embodiment, the second member link 180 and the platform link 178 maintain the rotational relationship between the second member 66 and the platform mount 24 such that the upper surface 50 of the platform mount maintains a substantially fixed angle relative to the horizon (e.g., as the lift mechanism 20 moves from the lowered configuration to the elevated configuration).

In one embodiment, the intersection of the first track 82 and the second track 96 controls the position of the journal 88 because the journal 88 is positioned within both tracks simultaneously. In one embodiment, the location of the intersection of the tracks changes relative to both tracks as the second member 66 moves relative to the first member 64. In one embodiment, the platform link is rotatable and movable relative to the platform pivot 30 such that the platform mount 24 rotates relative to the second member 66, thereby maintaining the orientation of the upper surface 50 as the journal follows the intersection of the tracks. In one embodiment, the layout of the first track 82 and the second track 96 is selected based on a path the journal 88 would take as the lift mechanism 20 moves between the lowered configuration and the elevated configuration while the upper surface 50 is parallel to the horizon. In another embodiment, the upper surface 50 may be configured to be at an angle relative to the horizon when the lift mechanism is in one of the elevated and lowered configurations.

Figure 16:
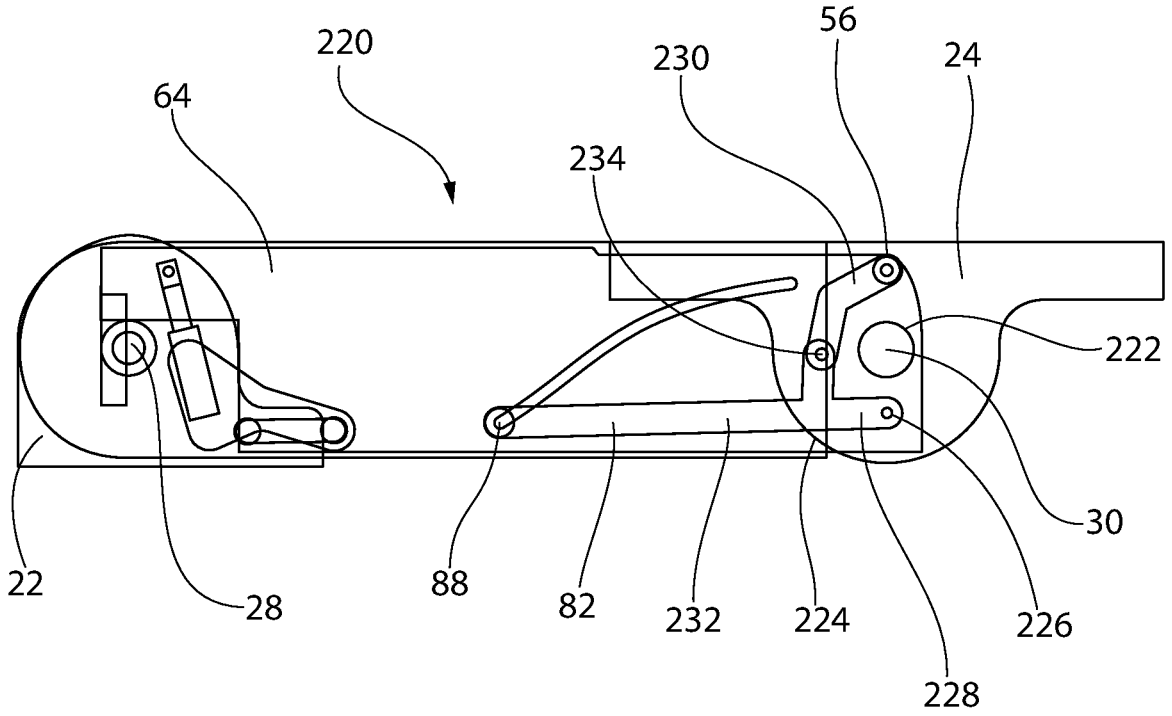
FIG. 16 is a side view of another embodiment of a lift mechanism in a lowered configuration in accordance with one embodiment of the present invention.
Figure 17:
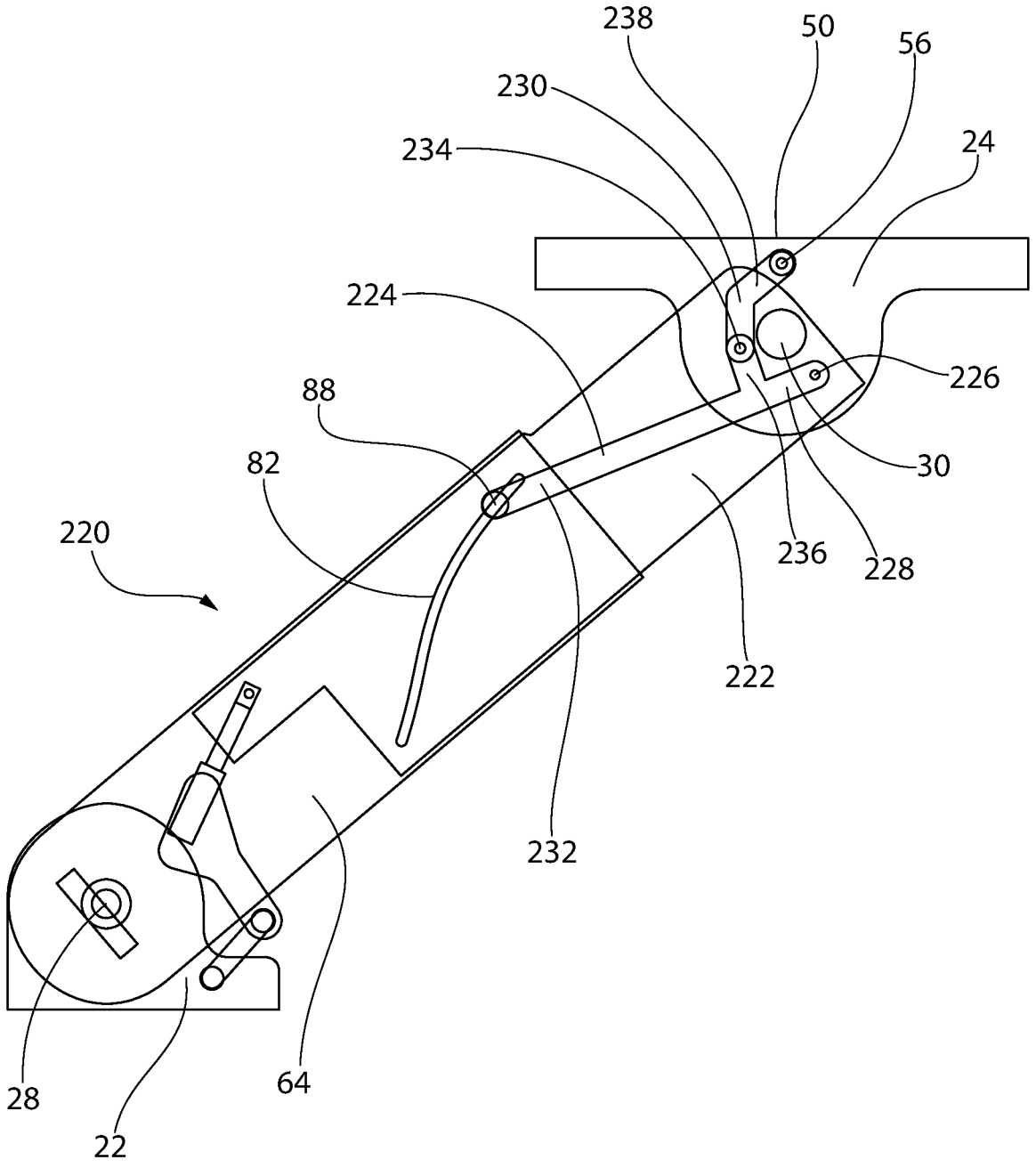
FIG. 17 is a side view of the lift mechanism of FIG. 16 in an elevated configuration.

Referring to FIGS. 16-17, there is shown an exemplary embodiment of a lift mechanism, generally designated 220. It will be apparent from the descriptions herein that the embodiments of FIGS. 16-17 including lift mechanism 220 is similar in many respects to embodiments of lift mechanism 20 all of which are not recited again here. In one embodiment, the second member 222 of lift mechanism 220 does not include a second track. In one embodiment, the platform link assembly 224 is rotatably coupled to the second member 222 at a second member pivot 226 such that the platform link assembly 224 rotates about the second member pivot 226 as the second member 222 moves relative to the first member 64.

In one embodiment, the platform link assembly 224 comprises a multi-branched link having a first branch 228 coupled to the second member pivot 226 and a second branch 230 coupled to a platform link pivot 56. In one embodiment, the platform link pivot 56 is positioned above the platform pivot 30. In one embodiment, the platform link pivot 56 is positioned below or to the side of the platform pivot 30. In one embodiment, the platform link assembly 224 comprises a third branch 232 coupled to the journal 88. In one embodiment, the second branch 230 comprises a knuckle 234 between a second branch first portion 236 and a second branch second portion 238. In one embodiment, the first portion 236 and second portion 238 are rotationally fixed relative to one another. In one embodiment, the first portion 236 and second portion 238 are configured for limited rotation between the two such that the top surface 50 undergoes an angular deflection relative to the horizon as the lift mechanism 220 moves from a lowered configuration (FIG. 16) to an elevated configuration (FIG. 17). In one embodiment, the journal 88 follows the track 82 in the first member 64 as the second member 222 moves relative to the first member. In one embodiment, the movement of the journal 88 causes the platform link assembly 224 to rotate relative to the second member 222 about the second member pivot 226. In one embodiment, rotation of the platform link assembly 224 about the second member pivot 226 causes the platform mount 24 to rotate relative to the second member 222 to maintain the orientation of the upper surface 50 relative to the horizon.

Figure 18:
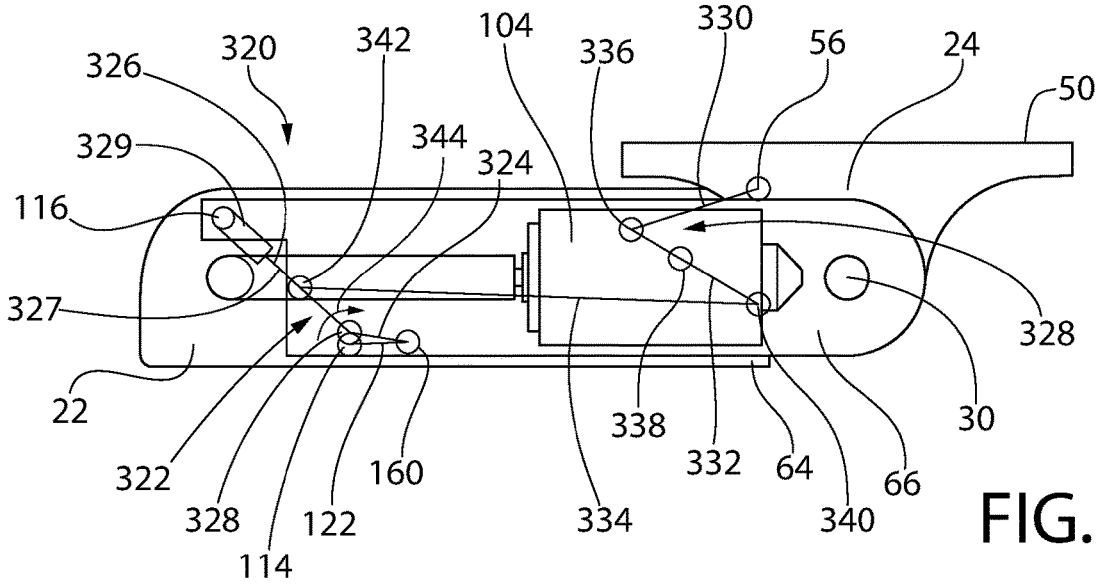
FIG. 18 is a side view of another embodiment of a lift mechanism in a lowered configuration in accordance with one embodiment of the present invention.
Figure 19:
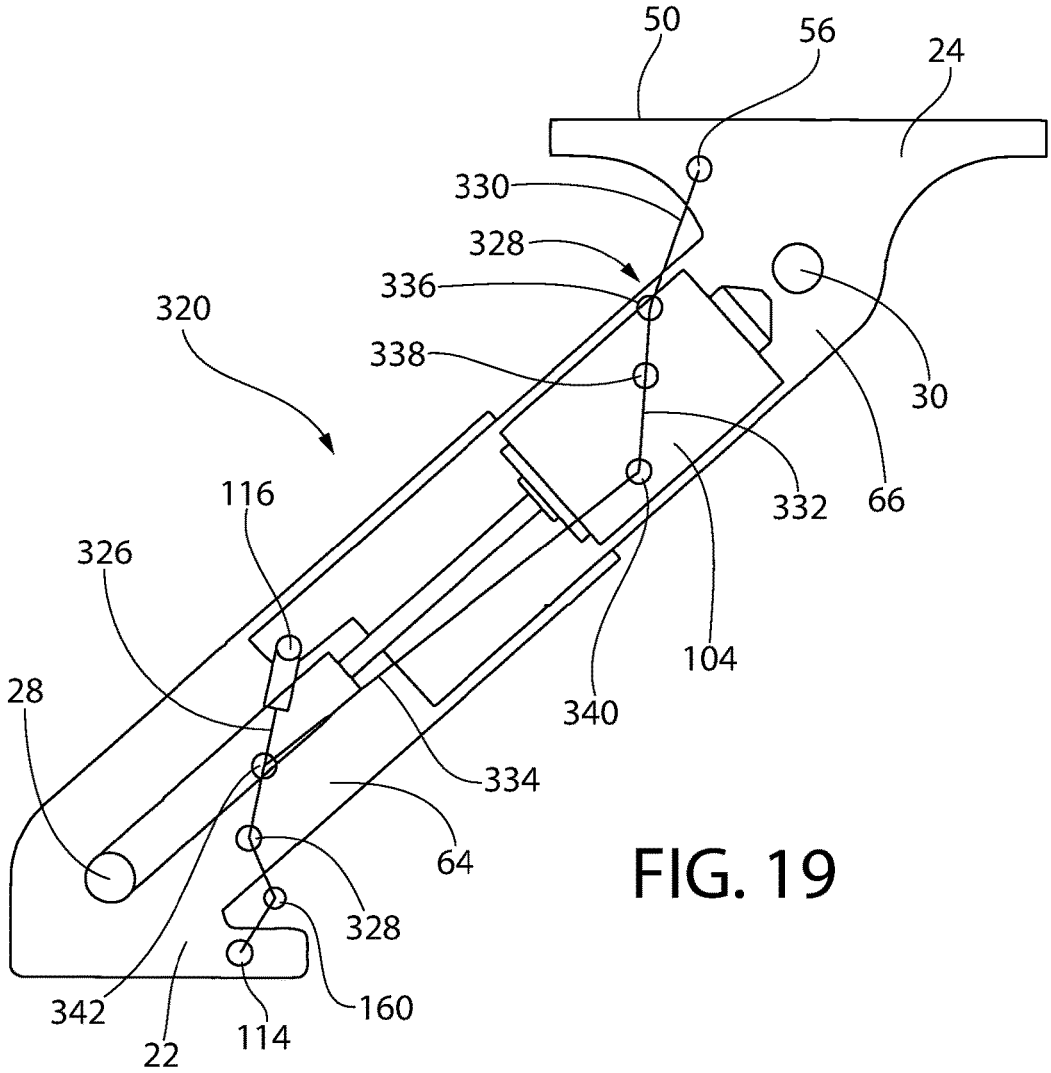
FIG. 19 is a side view of the lift mechanism of FIG. 17 in an elevated configuration.

Referring to FIGS. 18-19, there is shown an exemplary embodiment of a lift mechanism, generally designated 320. It will be apparent from the descriptions herein that the embodiments of FIGS. 18-19 including lift mechanism 320 is similar in many respects to embodiments of lift mechanism 20 all of which are not recited again here. In one embodiment, the lift mechanism 320 comprises a lifting link assembly 322 including the base link 124, a receiving link 324, and a lifting link 326. In one embodiment, the receiving link 324 is pivotably coupled to the lifting link 326 by a receiving pivot 328. In one embodiment, the receiving link 324 and the lifting link 326 are configured to rotate relative to one another and are preferably axially fixed relative to each other as the lift mechanism 320 moves from a lowered configuration (FIG. 18) to an elevated configuration (FIG. 19). In one embodiment, the receiving link 324 is rotatably coupled to the base link 122.

In one embodiment, the lifting link 326 is defined by an effective length as measured between the lifting link pivot 116 and the receiving pivot 328. In one embodiment, the lifting link 326 comprises a telescoping rod and cylinder construct such that the effective length of the lifting link 326 is configured to change as the lift mechanism moves from the lowered configuration to the elevated configuration. In one embodiment, the lifting link 326 comprises an inner lifting link 327 telescopically nested within an outer lifting link 329 such that the lifting link 326 telescopically expands and contracts as the lifting link 326 rotates relative to a first member 64.

In one embodiment the lift mechanism 320 comprises a platform link assembly 328 configured to maintain the orientation of the upper surface 50 relative to a horizon as the lift mechanism 320 moves from the lowered configuration to the raised configuration. In one embodiment, the platform link assembly 328 comprises a platform link 330, an intermediate link 332, and a connecting link 334. In one embodiment, platform link 330 is rotatably coupled to the platform mount 24 by the platform link pivot 56. In one embodiment, the platform link 330 is rotatably coupled to the intermediate link 332 by a coupling pivot 336 such that the platform link and intermediate link rotate relative to each other. In one embodiment, an intermediate pivot 338 is configured to rotatably couple the intermediate link 332 to the second member 66. In one embodiment, a connecting pivot 340 is configured to rotatably couple the connecting link to the intermediate link. In one embodiment, a second connecting link pivot 342 is configured to rotatably couple the connecting link 334 to the lifting link 326. In one embodiment, the connecting link 334 couples the lifting link assembly 322 to the platform link assembly 328 such that an orientation of the upper surface 50 is maintained with respect to the horizon as the lift mechanism 320 moves from the lowered configuration to the elevated configuration.

In one embodiment, movement of the second member 66 relative to the first member 64 causes the lifting link 326 to rotate relative to the receiving link 324 in direction 344. In one embodiment, the receiving link 324 is configured to rotate relative to the base link 122 as the lifting link 326 rotates relative to the receiving link 324. In one embodiment, the base link 122 is configured to rotate relative to the base 22 as the receiving link 324 rotates relative to the base link 122. In one embodiment, the first member 64 is configured to rotate relative to the base 22 as the base link 122 rotates relative to the base 22 and the base link 122, receiving link 324, and lifting link 326 rotate relative to one another such that the lift mechanism 320 moves from the lowered configuration to the raised configuration.

In one embodiment, the connecting link 334 is configured to rotate relative to the lifting link 326 as the lifting link rotates relative to the second member 66. In one embodiment, the connecting link 334 is configured to rotate relative to the intermediate link 336 as the connecting link 334 rotates relative to the lifting link 326. In one embodiment, the intermediate link 336 is configured to rotate about the intermediate pivot 338 relative to the second member 66 when the connecting link 334 rotates relative to the intermediate link 336. In one embodiment, the intermediate link 336 is configured to rotate relative to the platform link 330 as the intermediate link 336 rotates relative to the second member 66. In one embodiment, the platform link 330 is configured to rotate relative to the platform mount 24 as the platform link 330 rotates relative to the intermediate link 336. In one embodiment, the platform mount 24 is configured to rotate relative to the second member 66 as the platform link 330 rotates relative to the platform mount 24 such that an orientation of the upper surface 50 is maintained. In one embodiment, the connecting link 334 is coupled to each of the lifting link assembly 322 and the platform link assembly 328 such that the platform mount 24 and base 22 rotate relative to the member assembly 26 simultaneously.

In one embodiment, the platform link assembly 328 comprises the platform link 330, the intermediate link 332 link rotatably coupled to the platform link 330, and the connecting link 334 rotatably coupled to each of the intermediate link 332 and the lifting link assembly 322 such that the connecting link 334 rotates relative to the lifting link assembly 332 as the lifting link assembly rotates relative to the second member 66.

Figure 20:
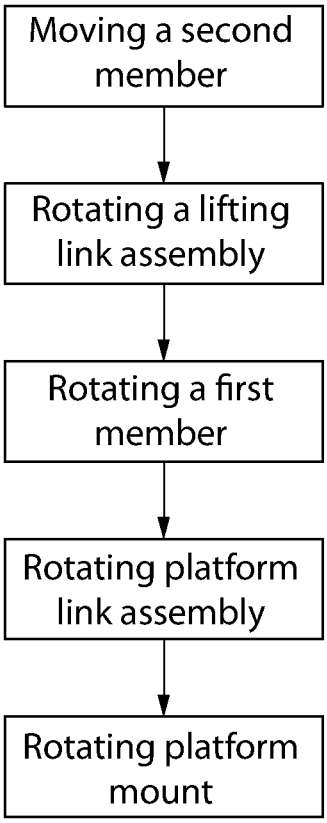
FIG. 20 is a flow chart showing a method of operating a lift mechanism in accordance with one embodiment of the present invention.

FIG. 20 illustrates an exemplary embodiment of a method of elevating a platform while maintaining an angular orientation of the platform with respect to a horizon. In one embodiment, the method includes moving a second member relative to a first member. In one embodiment, moving the second member relative to the first member includes rotating a lifting link assembly. In one embodiment, rotating the lifting link assembly includes rotating the first member relative to the base. In one embodiment, rotating the first member includes rotating a platform link assembly. In one embodiment, rotating the platform link assembly includes rotating a platform mount to maintain the orientation of the platform with respect to the horizon.

Several embodiments of the lift mechanism are described herein. Features from any embodiment may be included in any other embodiments. Although various embodiments are disclosed, features of distinct embodiments may be incorporated into any of the otherwise described embodiments.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. The words "right", "left", "lower" and "upper" designate directions in the drawings to which reference is made. Unless specifically set forth herein, the terms "a", "an" and "the" are not limited to one element but instead should be read as meaning "at least one". Each element may move in the opposite direction of motion described herein as the lift mechanism moves from the elevated configuration to the lowered configuration.

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

I claim:

1. A platform lift mechanism comprising:

a base;

a first member rotatably coupled to the base;

a second member coupled to the first member, the second member moveable with respect to first member between a first position and a second position;

a lifting link assembly rotatably coupled to each of the base and the second member, the lifting link assembly including:

a lifting link rotatably coupled to the second member; and a receiving link coupled to the lifting link;

a platform mount coupled to the second member, the platform mount rotatable about a platform pivot with respect to the second member; and wherein the lifting link assembly rotates relative to the first member, the second member, and the base as the second member moves relative to the first member, wherein the receiving link rotates relative to the base as the lifting link rotates relative to the first member, thereby causing the first member to rotate relative to the base, wherein the lifting link is coupled to the second member at a lifting link pivot, wherein the lifting link has an effective link length between the lifting link pivot and the receiving link, and wherein the effective link length is configured to change as the platform lift mechanism moves from a lowered configuration to an elevated configuration.

2. The platform lift mechanism of claim 1, further comprising a platform link assembly coupled to each of the second member and the platform mount, wherein the platform link assembly is configured to maintain an orientation of the platform mount.

3. The platform lift mechanism of claim 2, wherein the orientation of the platform includes one of:

a) an orientation of an aspect of the platform mount with respect to a horizon, b) an orientation of an aspect of the platform mount relative to a vertical plane passing through the platform mount, or c) both a) and b).

4. The platform lift mechanism of claim 1, wherein the lifting link assembly further includes base link rotatably coupled to the base, wherein the receiving link rotates relative to the base link as the lifting link rotates relative to the first member, thereby causing the first member to rotate relative to the base.

5. The platform lift mechanism of claim 1, wherein the platform mount moves from a lowered position to an elevated position as the platform lift mechanism moves from a lowered configuration to an elevated configuration.

6. The platform lift mechanism of claim 5, wherein a plane fixed on the platform mount maintains a substantially fixed angle relative to a horizon as the platform mount moves from the lowered position to the elevated position as the lift mechanism moves from the lowered configuration to the elevated configuration.

7. The platform lift mechanism of claim 5, wherein a center of gravity of the platform mount remains at a substantially fixed horizontal distance from a point where the first member is pivotably mounted to the base as the platform mount moves from the lowered position to the elevated position as the lift mechanism moves from the lowered configuration to the elevated configuration.

8. The platform lift mechanism of claim 1, wherein the platform mount lies within a vertical plane when the platform lift mechanism is in a lowered configuration and the platform mount moves a maximum of 2 inches from the vertical plane as the platform lift mechanism moves from the lowered configuration to an elevated configuration.

9. The platform lift mechanism of claim 1, wherein one of the first member and the second member are telescopically nested within the other of the first member and the second member.

10. The platform lift mechanism of claim 1, wherein the second member is translatable with respect to the first member.

11. The platform lift mechanism of claim 1, further comprising an actuator coupled to the second member and configured to move the second member relative to the first member.

12. The platform lift mechanism of claim 11 wherein the actuator comprises at least one of a piston within a cylinder and a threaded rod.

13. The platform lift mechanism of claim 1, wherein the receiving link is configured to slidingly receive the lifting link such that the effective link length changes as the lift mechanism moves from the lowered configuration to the elevated configuration.

14. The platform lift mechanism of claim 1, wherein the lifting link comprises an inner lifting link telescopically nested within an outer lifting link such that the lifting link telescopically expands and contracts as the lifting link rotates relative to the first member.

15. The platform lift mechanism of claim 1, wherein the lifting link is rotationally fixed relative to the receiving link.

16. The platform lift mechanism of claim 2, wherein the platform link assembly includes a platform link rotatably coupled to the platform mount and movably coupled to the first member.

17. The platform lift mechanism of claim 16, wherein the first member includes a first member track and the platform link includes a journal configured to move along the first member track as the platform lift mechanism moves from a lowered configuration to an elevated configuration.

18. The platform lift mechanism of claim 17, wherein the first member track includes a first arcuate portion.

19. The platform lift mechanism of claim 18, wherein the first member track includes a second arcuate portion connected to the first arcuate portion, one of the first arcuate portion and the second arcuate portion being convex relative to a lower surface of the first member and the other of the first arcuate portion and the second arcuate portion being concave relative to the lower surface of the first member.

20. The platform lift mechanism of claim 17, wherein the second member includes a second member track and the journal is configured to move along the first member track and the second member track simultaneously as the lift mechanism moves from the lowered configuration to the elevated configuration.

21. The platform lift mechanism of claim 2, wherein the platform link assembly includes a platform link;

an intermediate link rotatably coupled to the platform link; and a connecting link rotatably coupled to each of the intermediate link and the lifting link assembly such that the connecting link rotates relative to the lifting link assembly as the lifting link assembly rotates relative to the second member.

22. The platform lift mechanism of claim 21, wherein the connecting link is rotatably coupled to the lifting link.

23. The platform lift mechanism of claim 21, wherein the intermediate link is rotatably coupled to the second member at an intermediate pivot.

24. The platform lift mechanism of claim 23, wherein the intermediate link rotates about the intermediate pivot point as the connecting link rotates relative to the lifting link assembly.

25. The platform lift mechanism of claim 24, wherein the platform link rotates relative to each of the intermediate link and the platform mount as the intermediate link rotates about the intermediate pivot point.

26. The platform lift mechanism of claim 25, wherein the platform mount rotates relative to the second member as the platform link rotates relative to the platform mount such that the orientation of the platform mount with respect to a horizon is maintained.

27. The platform lift mechanism of one of claim 4, wherein the first member includes a cavity and the second member, lifting link, receiving link, and base link are at least partially within the cavity when the platform lift mechanism is in the lowered configuration.

28. A platform lift mechanism comprising:

a base;

a first member rotatably coupled to the base;

a second member coupled to the first member, the second member moveable with respect to first member between a first position and a second position;

a lifting link assembly rotatably coupled to each of the base and the second member, the lifting link assembly including:

a lifting link rotatably coupled to the second member; and receiving link coupled to the lifting link;

a platform mount coupled to the second member, the platform mount rotatable about a platform pivot with respect to the second member, wherein the lifting link assembly rotates about a link pivot relative to the first member, the second member, and the base as the second member moves relative to the first member, thereby causing the first member to rotate relative to the base, wherein a center of gravity of the platform mount remains at a substantially fixed horizontal distance from the link pivot as the platform mount moves from the lowered position to the elevated position, and wherein the first member includes a cavity and the second member, lifting link, receiving link, and base link are at least partially within the cavity when the platform lift mechanism is in the lowered configuration.

* * * * *